US009789359B2

(12) United States Patent
Sassano et al.

(10) Patent No.: US 9,789,359 B2
(45) Date of Patent: Oct. 17, 2017

(54) PUSH UP APPARATUS AND METHODS

(71) Applicant: Q Holdings LLC, New York, NY (US)

(72) Inventors: Patrick Sassano, Mullica Hill, NJ (US); Malcolm Lawson, Washington, DC (US); Jordan Diatlo, New York, NY (US); Aaron Saxton, New York, NY (US); Laura Sink, New York, NY (US); Przemek Godycki, New York, NY (US)

(73) Assignee: Q Holdings LLC, New York, NY (US)

( * ) Notice: Subject to any disclaimer, the term of this patent is extended or adjusted under 35 U.S.C. 154(b) by 0 days.

(21) Appl. No.: 15/136,439

(22) Filed: Apr. 22, 2016

(65) Prior Publication Data

US 2017/0001069 A1 Jan. 5, 2017

Related U.S. Application Data

(63) Continuation of application No. 13/952,942, filed on Jul. 29, 2013, now abandoned.

(60) Provisional application No. 61/678,003, filed on Jul. 31, 2012.

(51) Int. Cl.
*A63B 23/12* (2006.01)
*A63B 23/02* (2006.01)
(Continued)

(52) U.S. Cl.
CPC ..... *A63B 23/1236* (2013.01); *A63B 21/068* (2013.01); *A63B 21/4035* (2015.10);
(Continued)

(58) Field of Classification Search
CPC ..... A63B 21/072; A63B 21/075; A63B 21/0726; A63B 22/20; A63B 22/201; A63B 22/203
(Continued)

(56) References Cited

U.S. PATENT DOCUMENTS 5,632,707 A * 5/1997 Daniel ..... A63B 22/20 482/117
6,634,998 B2 10/2003 Siaperas
(Continued)

FOREIGN PATENT DOCUMENTS

CN 201727878 2/2011

OTHER PUBLICATIONS

Euro-Bearings (Model No. NL-8, Euro-Bearings, Ltd, of Milton Keynes, UK; see the applicants' written description at p. 7, Lines 4-11).*

(Continued)

*Primary Examiner* — Sundhara Ganesan
*Assistant Examiner* — Rae Fischer
(74) *Attorney, Agent, or Firm* — Hard IP LLC

(57) ABSTRACT

One or more aspects comprise an apparatus comprising: (a) a base component comprising a flat lower surface and a concave upper surface having a first curvature; and (b) a handle component comprising a convex lower surface having a second curvature; wherein the first curvature and the second curvature conform sufficiently to allow the handle component to rotate three-dimensionally within the base component, and wherein at least one of the concave upper surface and the convex lower surface comprises means to allow the handle component to rotate three-dimensionally within the base component. Other aspects and embodiments, including methods of use and manufacture, will be apparent to those skilled in the art after reviewing the description and drawings provided herein.

10 Claims, 48 Drawing Sheets

(51) Int. Cl.
*A63B 22/18* (2006.01)
*A63B 21/00* (2006.01)
*A63B 21/068* (2006.01)

(52) U.S. Cl.
CPC ..... *A63B 22/18* (2013.01); *A63B 23/02* (2013.01); *A63B 2022/185* (2013.01); *A63B 2209/10* (2013.01)

(58) Field of Classification Search
USPC ..... 482/141
See application file for complete search history.

(56) References Cited

U.S. PATENT DOCUMENTS 7,468,025 B2 * 12/2008 Hauser ..... A63B 21/00047 482/141
7,503,884 B1 * 3/2009 Schall ..... A63B 21/00047 482/115
7,585,262 B1 9/2009 Vayntraub
7,909,746 B2 * 3/2011 Gant ..... A63B 21/00047 482/141
8,105,218 B1 * 1/2012 Vayntraub ..... A63B 23/1236 482/141
2007/0243946 A1 10/2007 Wu
2010/0113225 A1 5/2010 Mills et al.
2010/0279833 A1 11/2010 Gant

OTHER PUBLICATIONS

International Search Report and Written Opinion of International Application No. PCT/US2013/052471, dated Dec. 5, 2013, 7 pgs.
Global Industrial Ball Transfer Search, URL: http://www.globalindustrial.com/c/material-handling/conveyors/ball-transfer, retrieved on Oct. 3, 2016, 4 pgs.

* cited by examiner

PUSH UP APPARATUS AND METHODS

CROSS-REFERENCE TO RELATED APPLICATIONS

This application claims priority to U.S. patent application Ser. No. 13/952,942, filed Jul. 29, 2013, which claims priority to U.S. Provisional Patent Application No. 61/678,003, filed Jul. 31, 2012, entitled "Push Up Apparatus and Methods." The entire contents of the above-referenced application are incorporated herein by reference.

INTRODUCTION

Current push-up bars create a strain on the wrist joints. When bars are placed close together or far apart, the wrists have to bend at an awkward angle when raising and lowering the body. While some known push up bars comprise handles that rotate in a plane, those handles continue to place the hands, wrists, and/or forearms in stressful positions. The rotation on a flat plane does not compensate for the natural angular movement of the body's joints and limbs for most positions of a pushup. The wrist joints are still strained because of the bar/grip design.

Push up bars of an exemplary embodiment greatly reduce such wrist strain. When a user is performing a push up, an exemplary embodiment greatly reduces bending and compression of the wrist joints that results in wrist fatigue and pain. The user can optimize the user's workout by working until the targeted muscle groups are exhausted, instead of stopping when forced to do so by wrist fatigue or discomfort.

Because an exemplary embodiment forces the body to balance and stabilize itself, it incorporates more muscle groups than other push-up devices. As with a gymnast on rings, an exemplary embodiment challenges the body to constantly stabilize, balance and correct itself, resulting in a more intensive workout.

One or more aspects comprise an apparatus comprising: (a) a base component comprising a flat lower surface and a concave upper surface having a first curvature; and (b) a handle component comprising a convex lower surface having a second curvature; wherein the first curvature and the second curvature conform sufficiently to allow the handle component to rotate within the base component, and wherein at least one of the concave upper surface and the convex lower surface comprises means to allow the handle component to rotate within the base component.

In various exemplary embodiments: (1) the handle component has a concave upper surface; (2) the handle component comprises a handle that extends between opposite sides of the concave upper surface; (3) at least one of the concave upper surface and the convex lower surface comprises a plurality of conveyor ball transfer assemblies; (4) at least one of the concave upper surface and the convex lower surface comprises a non-stick coating; (5) at least one of the concave upper surface and the convex lower surface comprises one or more hook-and-loop fasteners; (6) each of the conveyor ball transfer assemblies comprises a single ball having a first diameter, which rides on a plurality of balls having a second diameter; (7) the single ball is a nylon ball; (8) the plurality of balls are steel balls; (9) the flat lower surface of the base component comprises a non-skid layer; and (10) the handle is enclosed within a foam grip.

Other aspects and embodiments, including methods of use and manufacture, will be apparent to those skilled in the art after reviewing the description and drawings provided herein.

DESCRIPTION OF SELECT EXEMPLARY EMBODIMENTS

Figure 1:
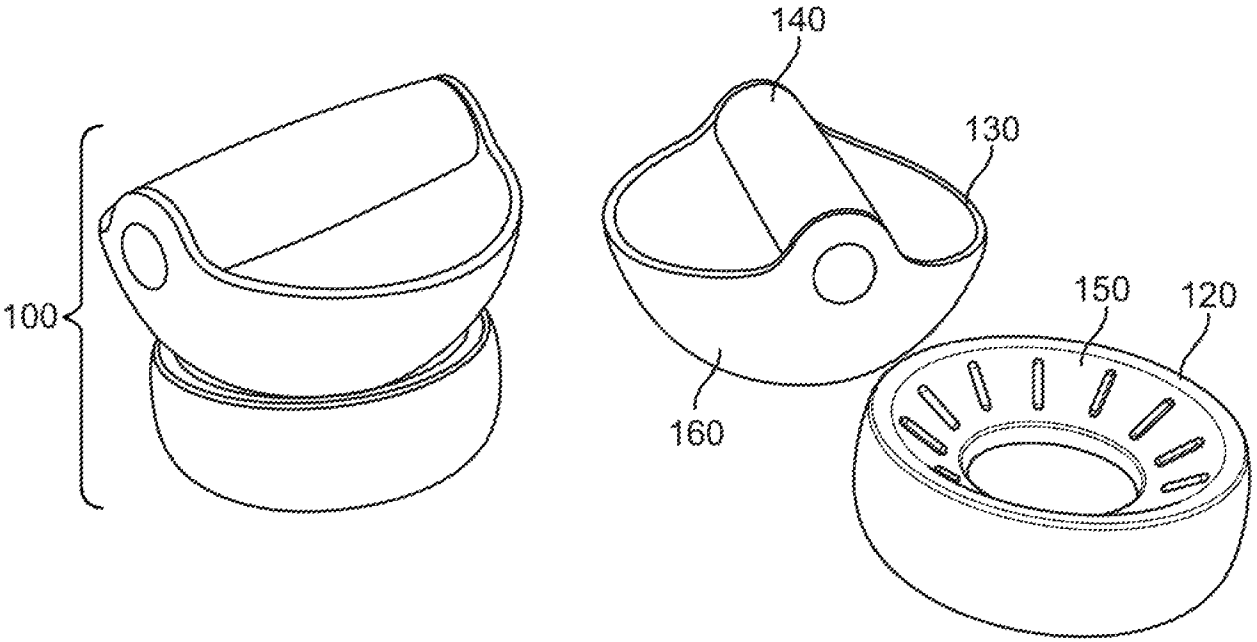
FIG. 1 depicts an exemplary embodiment.
Figure 2:
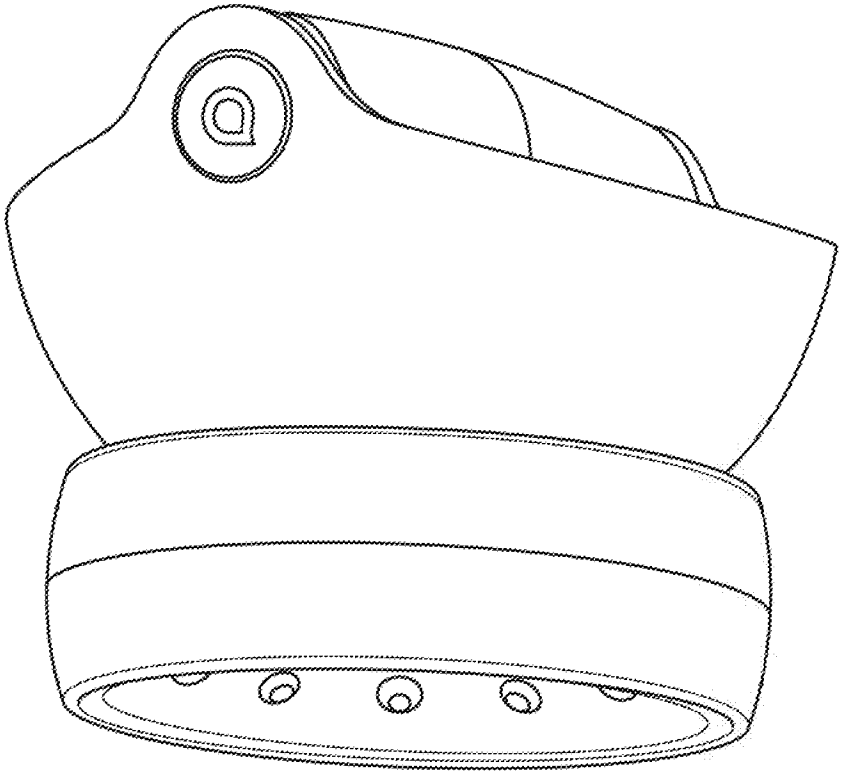
FIGS. 2-6 depict additional exemplary embodiments.
Figure 3:
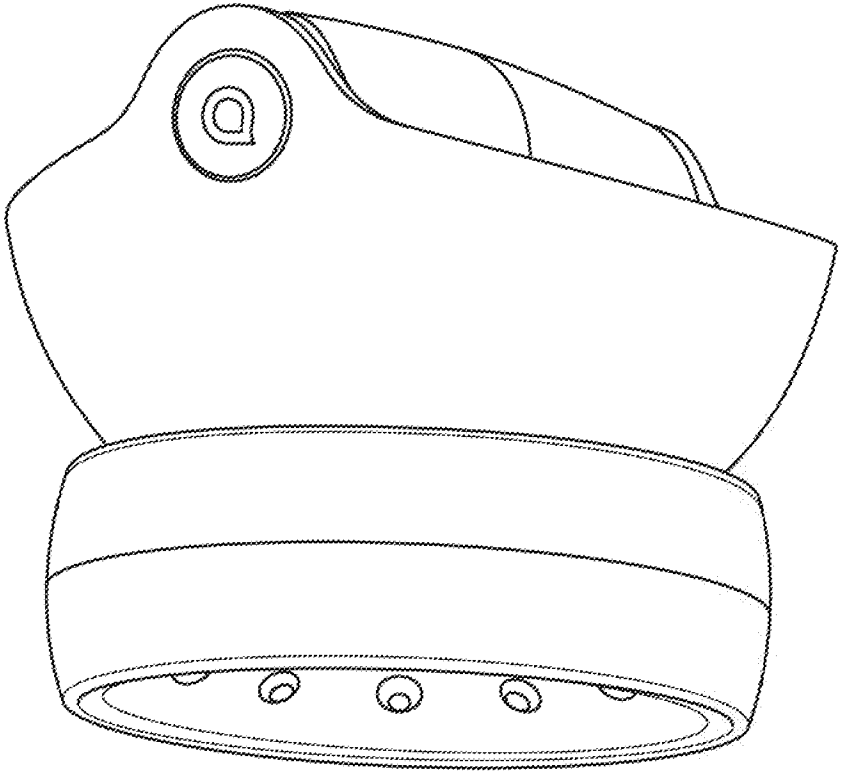
Figure 4:
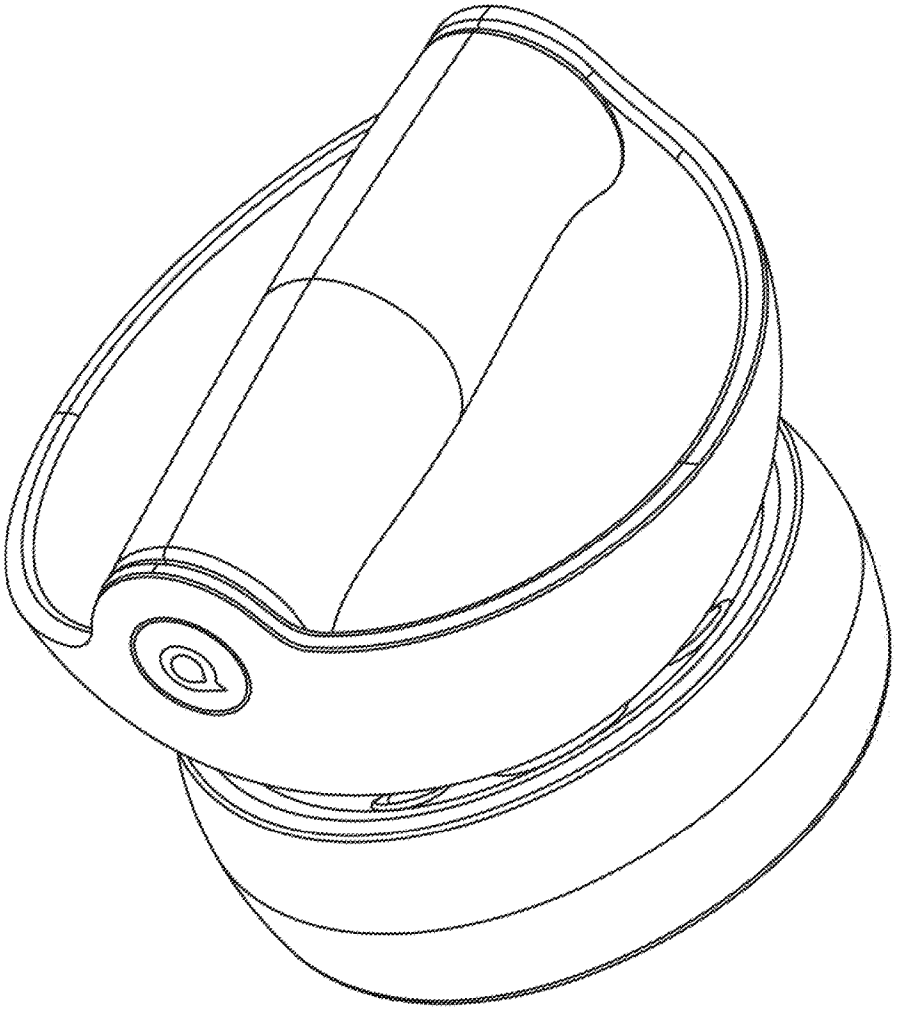
Figure 5:
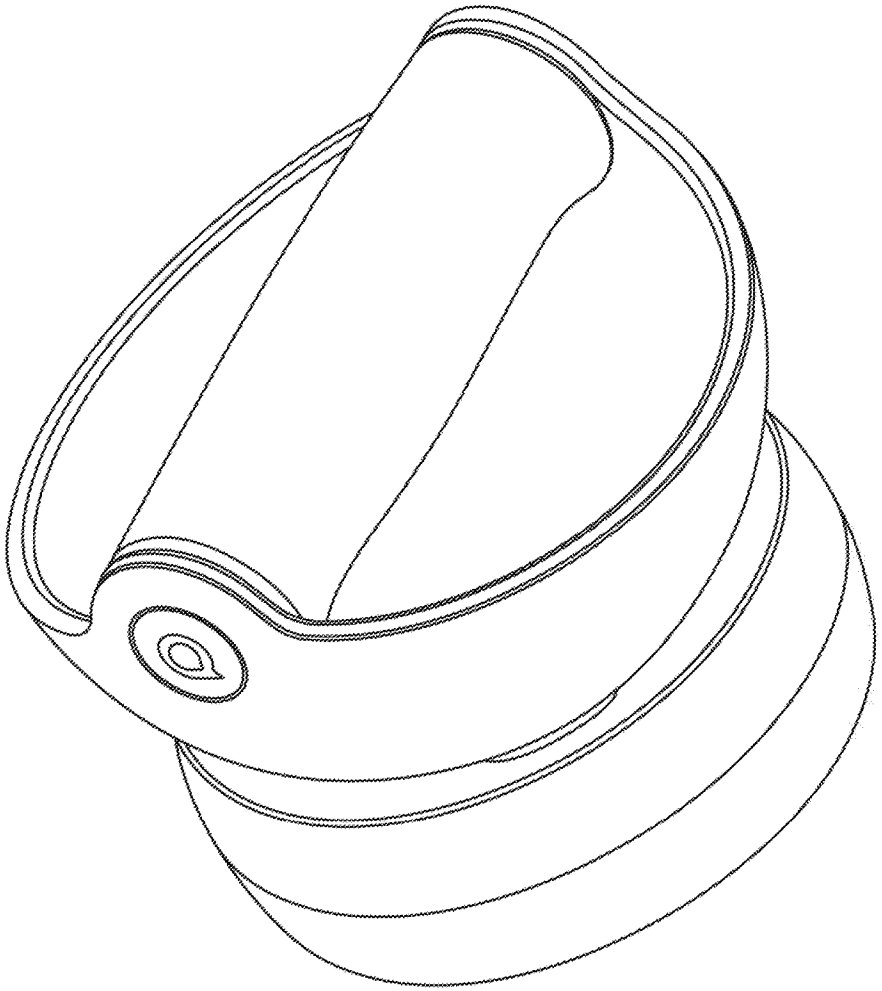
Figure 6:
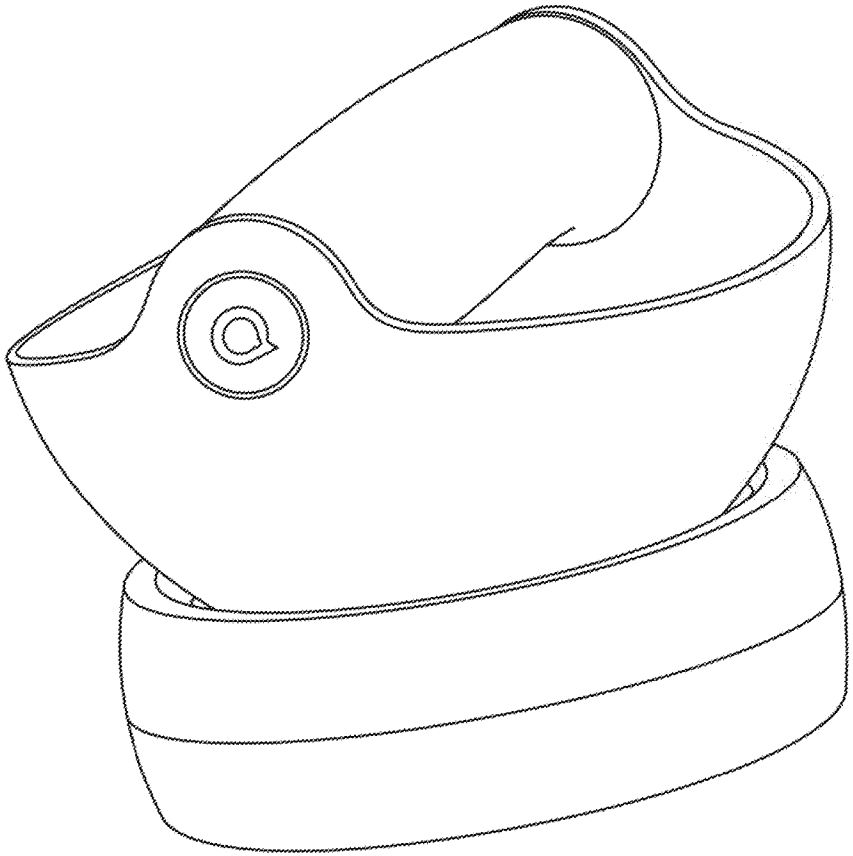

FIG. 1 depicts an exemplary embodiment of a push up apparatus 100. In this embodiment, the apparatus 100 comprises two separate components: a base 120 and a handle component 130, comprising a "hemispherical" shell component connected to a handle 140. Base 120 includes a lower surface (not viewable in FIG. 1) and a concave upper surface 150. Handle component 130 includes a convex lower surface 160.

Those skilled in the art will understand that the term "hemispherical" is used loosely in this context, and that the shape of the shell only needs to be sufficiently rounded. For example, instead of a portion of a sphere, the shell component's shape may be a portion of an ellipsoid, spheroid, catenoid, paraboloid, or other rounded shape.

Figure 22:
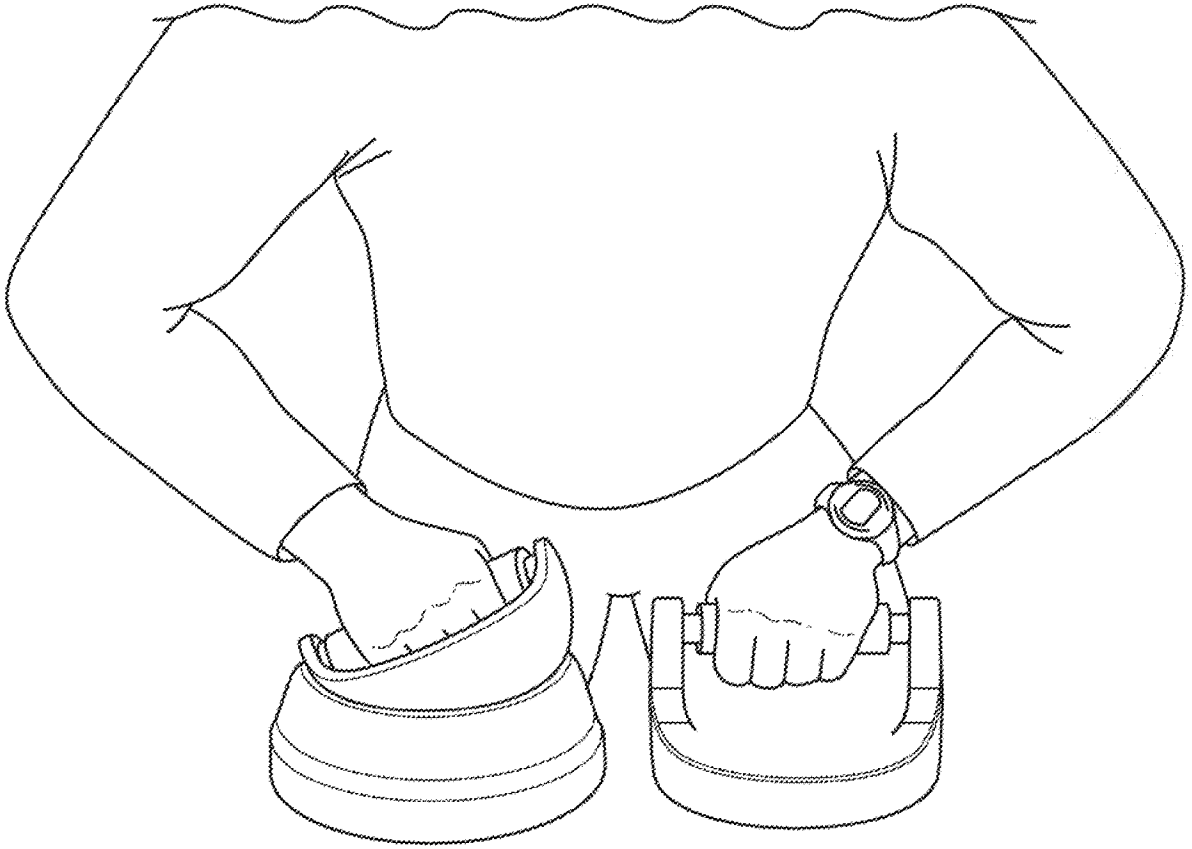
FIGS. 22-24 depict exemplary usage.
Figure 23:
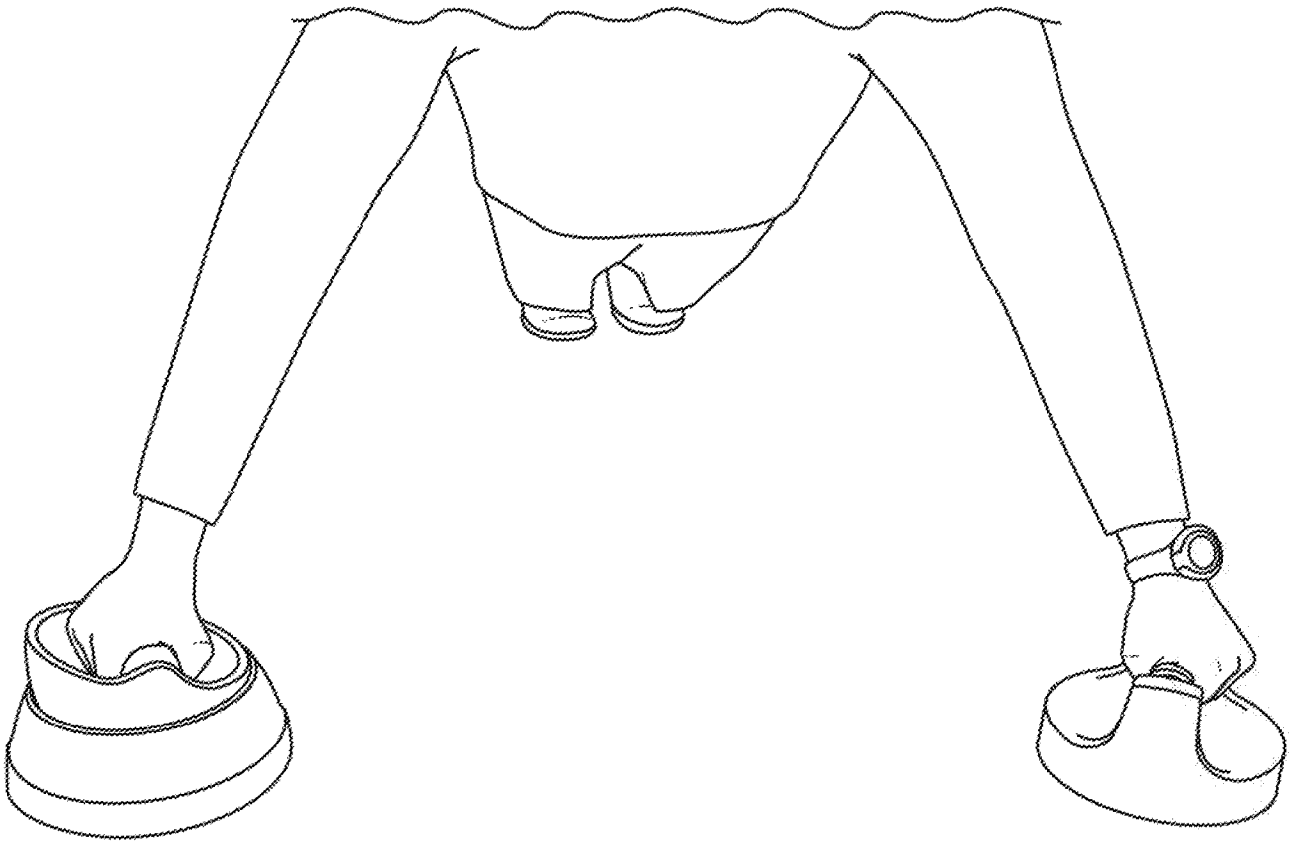
Figure 24:
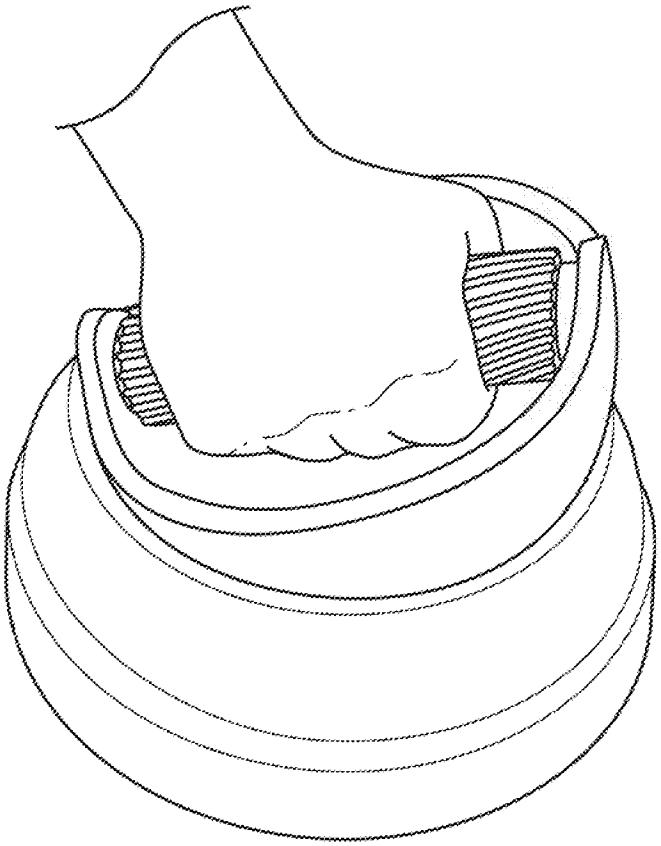

Various methods of use and benefits over push up bars that rotate only in a plane are depicted in FIGS. 22-24. As shown in FIG. 22, a user of an exemplary embodiment is able to keep his (right-hand) wrist straight, while a handle that rotates only in a plane forces the (left-hand) wrist to bend to the side. See also FIGS. 23 and 24.

The base 120 of an exemplary embodiment may be reversible, in the sense that either side of the base 120 may be used to support handle component 130. One side of the base may have less friction, allowing the handle to move more freely, and the other side may have more friction, to reduce movement of the handle.

Figure 7:
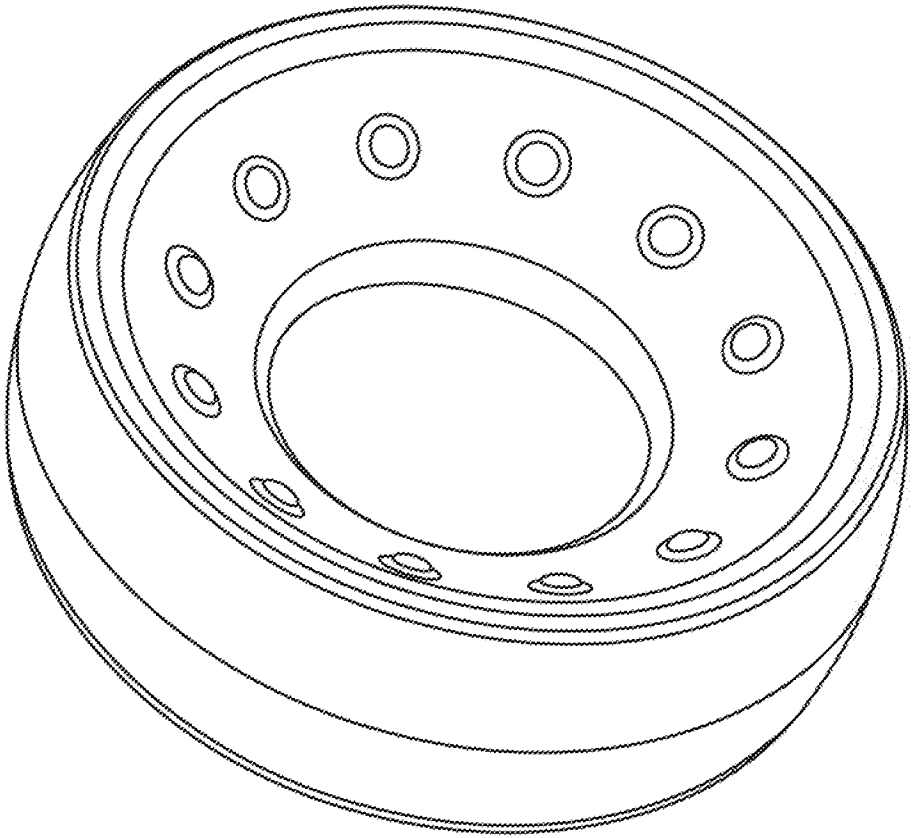
FIGS. 7-14 depict bases that may be used in exemplary embodiments.
Figure 8:
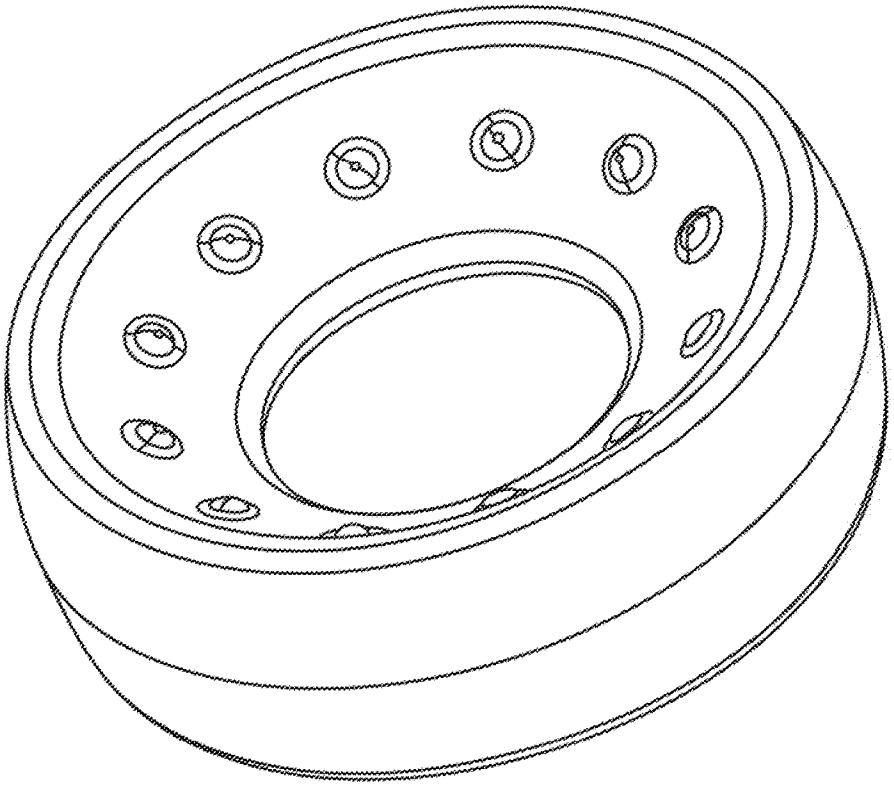
Figure 9:
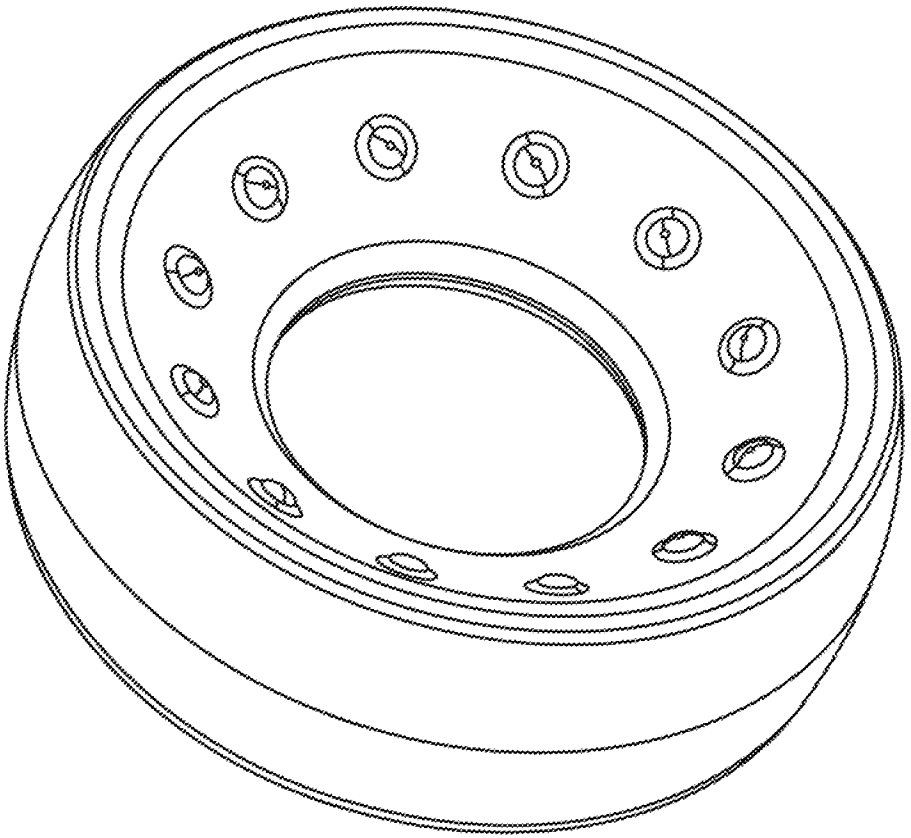
Figure 10:
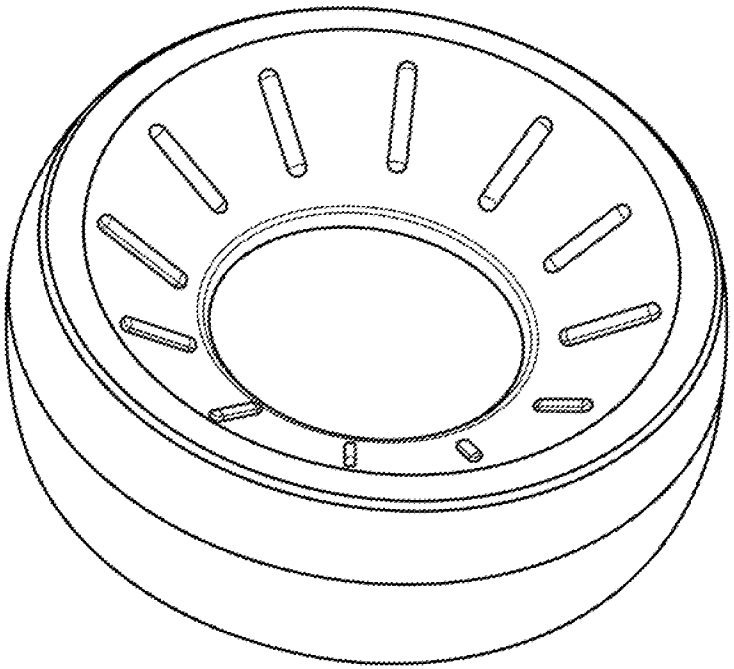
Figure 11:
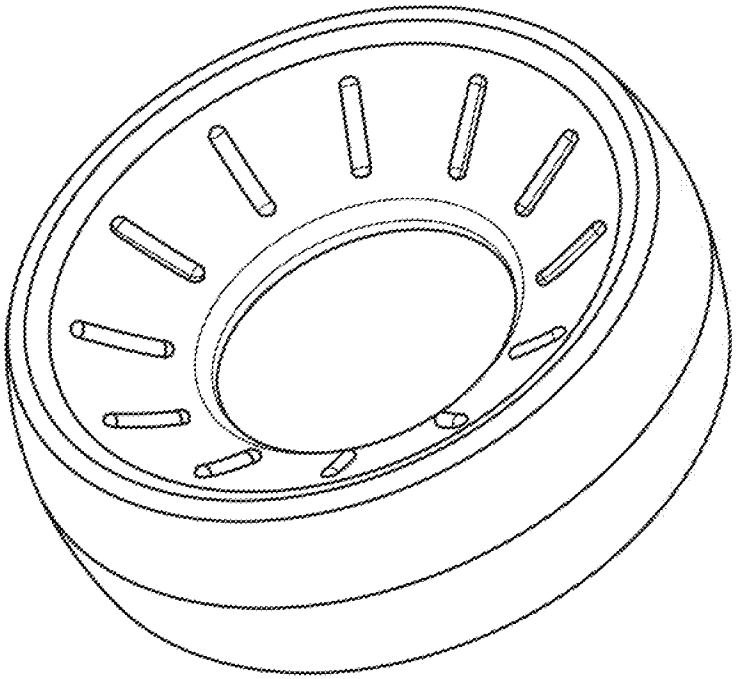
Figure 12:
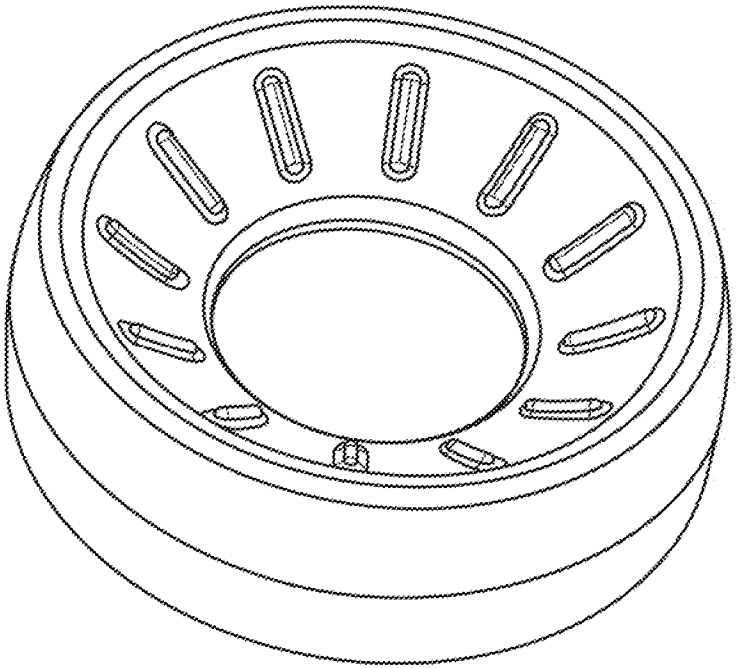
Figure 13:
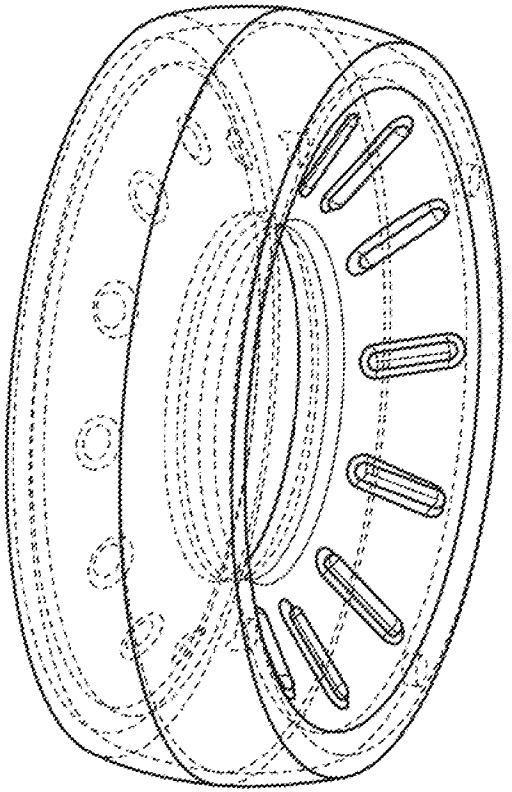
Figure 14:
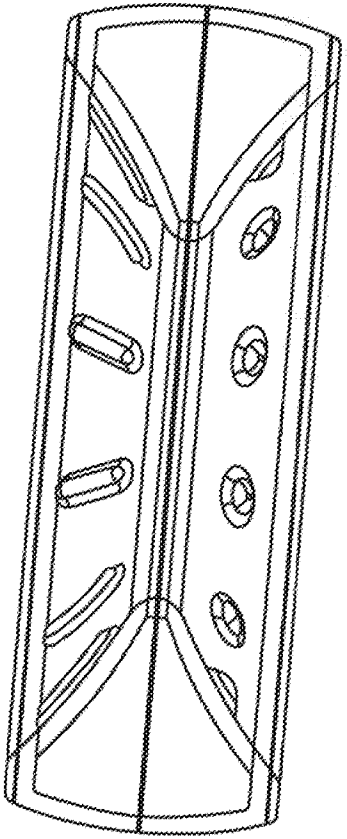
Figure 15:
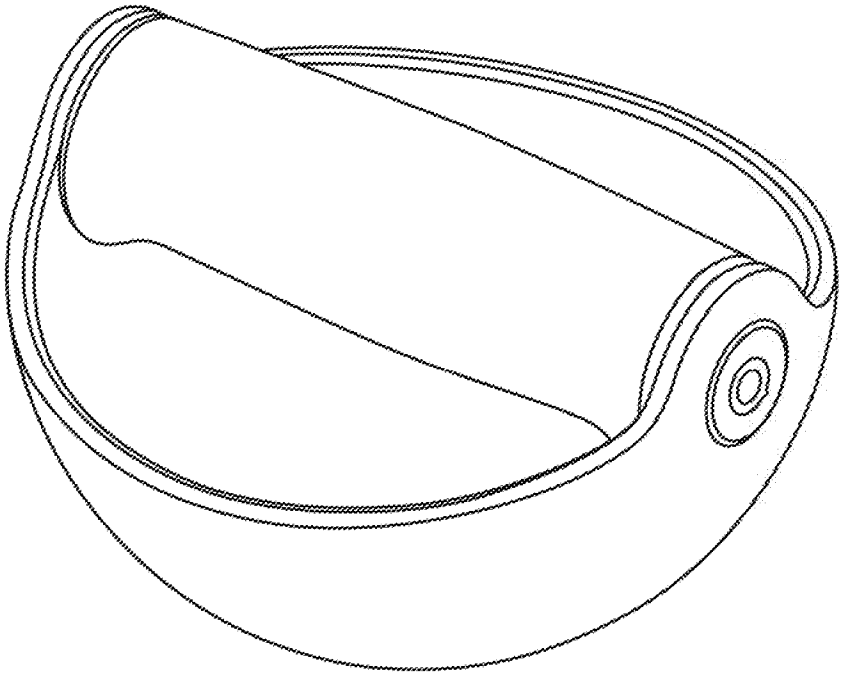
FIGS. 15-19 depict handle components that may be used in exemplary embodiments.
Figure 16:
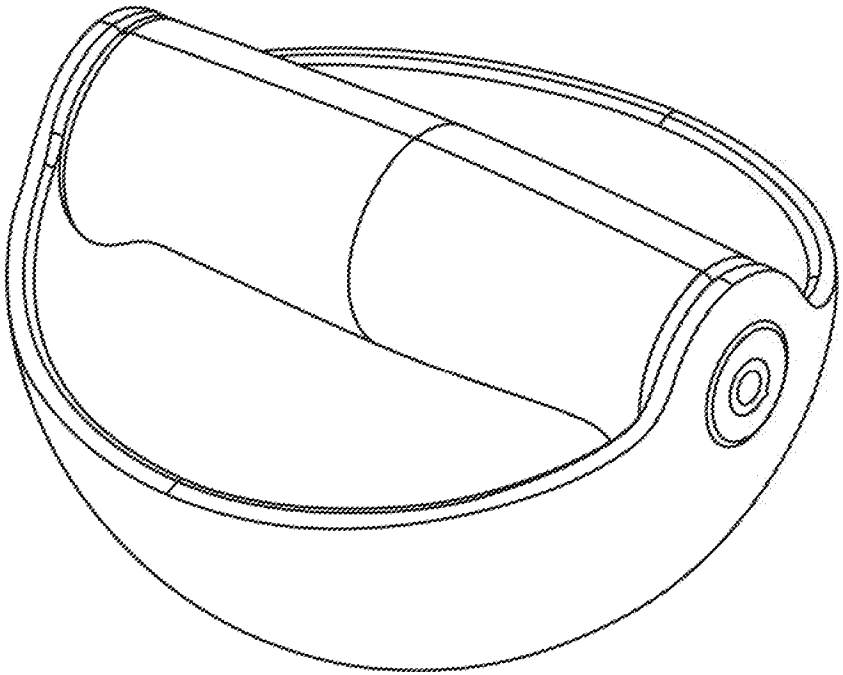
Figure 17:
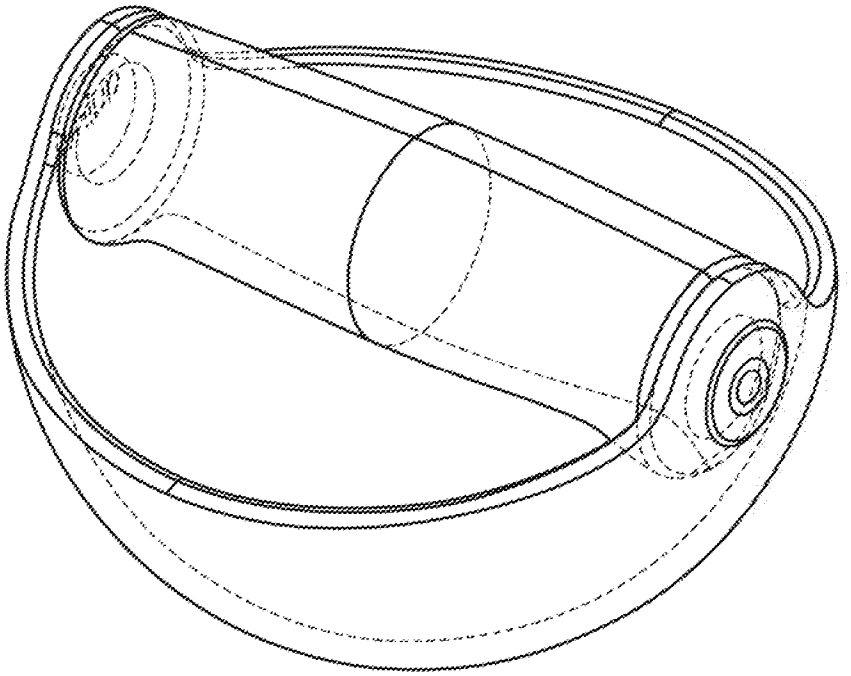
Figure 18:
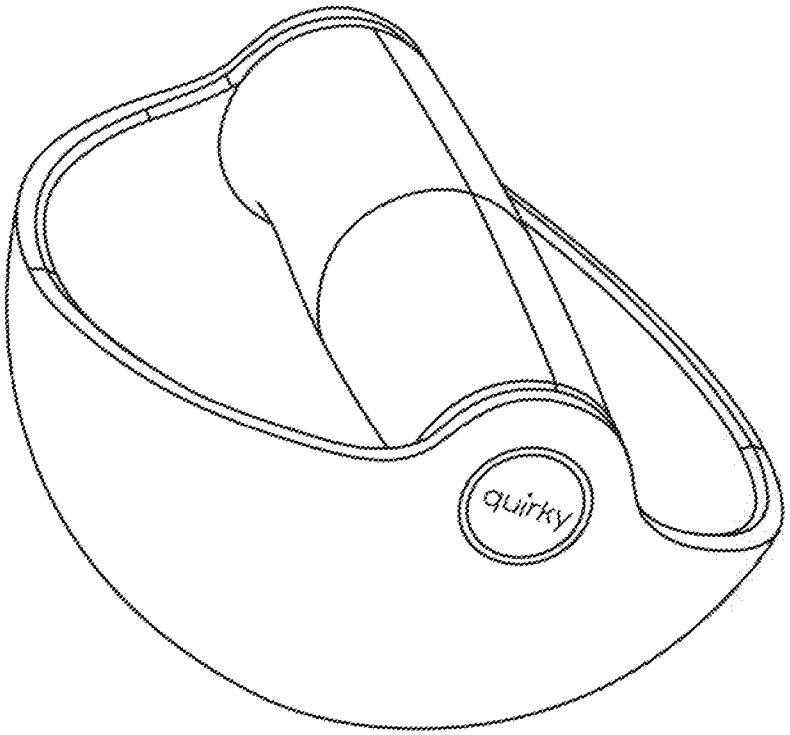
Figure 19:
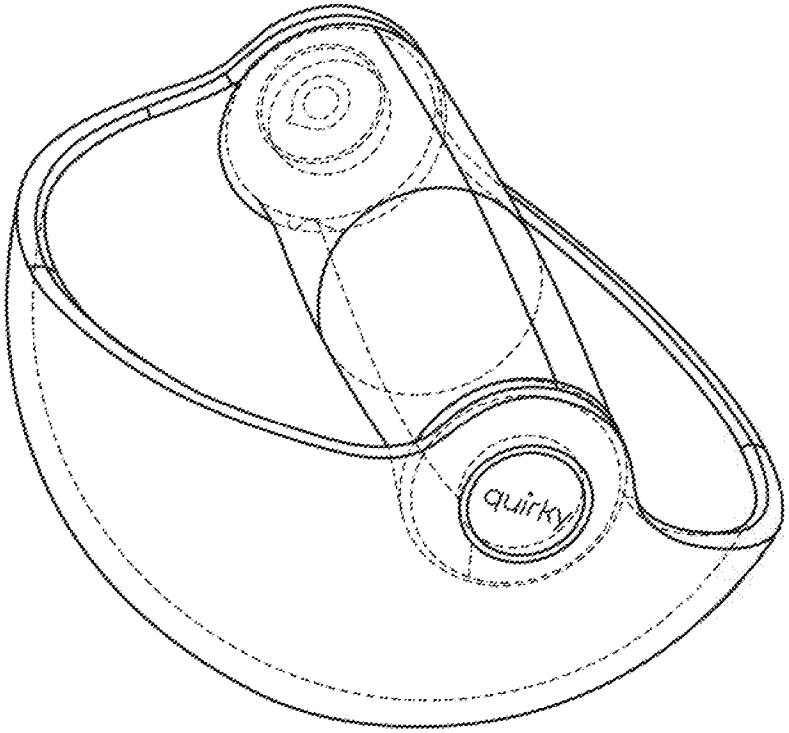
Figure 20:
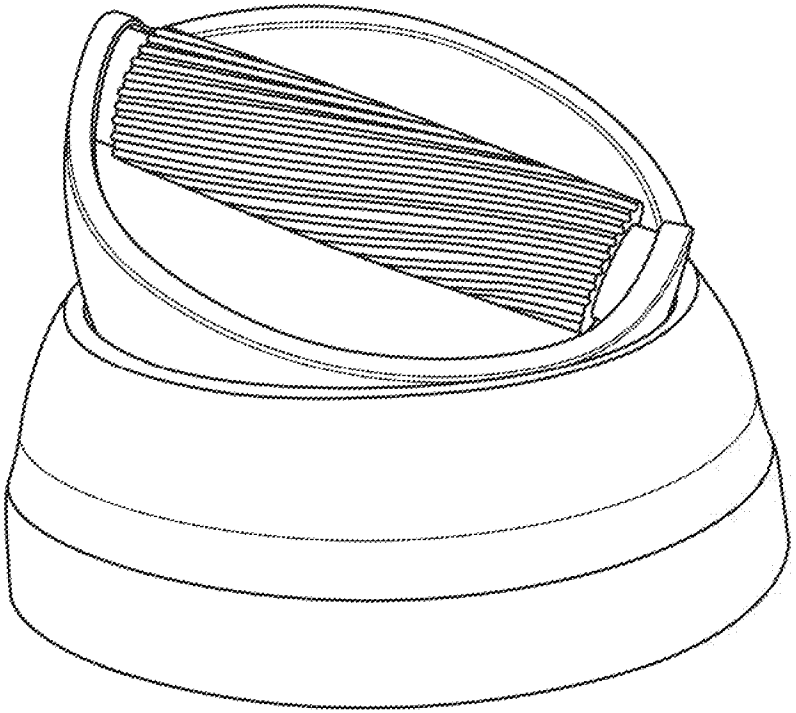
FIG. 20 depicts an additional exemplary embodiment.

As shown in FIG. 1, protrusions may be used to vary the frictional resistance between the base and the shell portion. The protrusions shown in FIG. 1 are pill-shaped (20 mm long, 4 mm wide), although those skilled in the art will understand that other shapes and dimensions could be used. See also FIGS. 10-12. Exemplary protrusions for the opposite side of the base are shown in FIGS. 7-9. These "round dimples" may be, for example, 6.5 mm in diameter.

Other exemplary embodiments may use other means of increasing or reducing friction between the base and the shell component. For example, means to allow the shell portion of the handle component to rotate within the base component may comprise ball bearings, non-stick coatings, or other friction-reducing means known to those skilled in the art. Also, hook-and-loop fasteners, or other means of immobilization, may be used by users who wish to immobilize the handle component 130 at a particular angle.

An exemplary material for the base and shell components (including a core for handle 140) is glass-filled (i.e., glass-reinforced) polycarbonate. Exemplary brands of glass-filled polycarbonate include Lexan® 3412, Lexan® 3413, Lexan® 3414, Lexan® 500, Susta® PC GF20, Tecanat™ GF20, Unicar® RG, although those skilled in the art will understand that any suitable material may be used.

Figure 21:
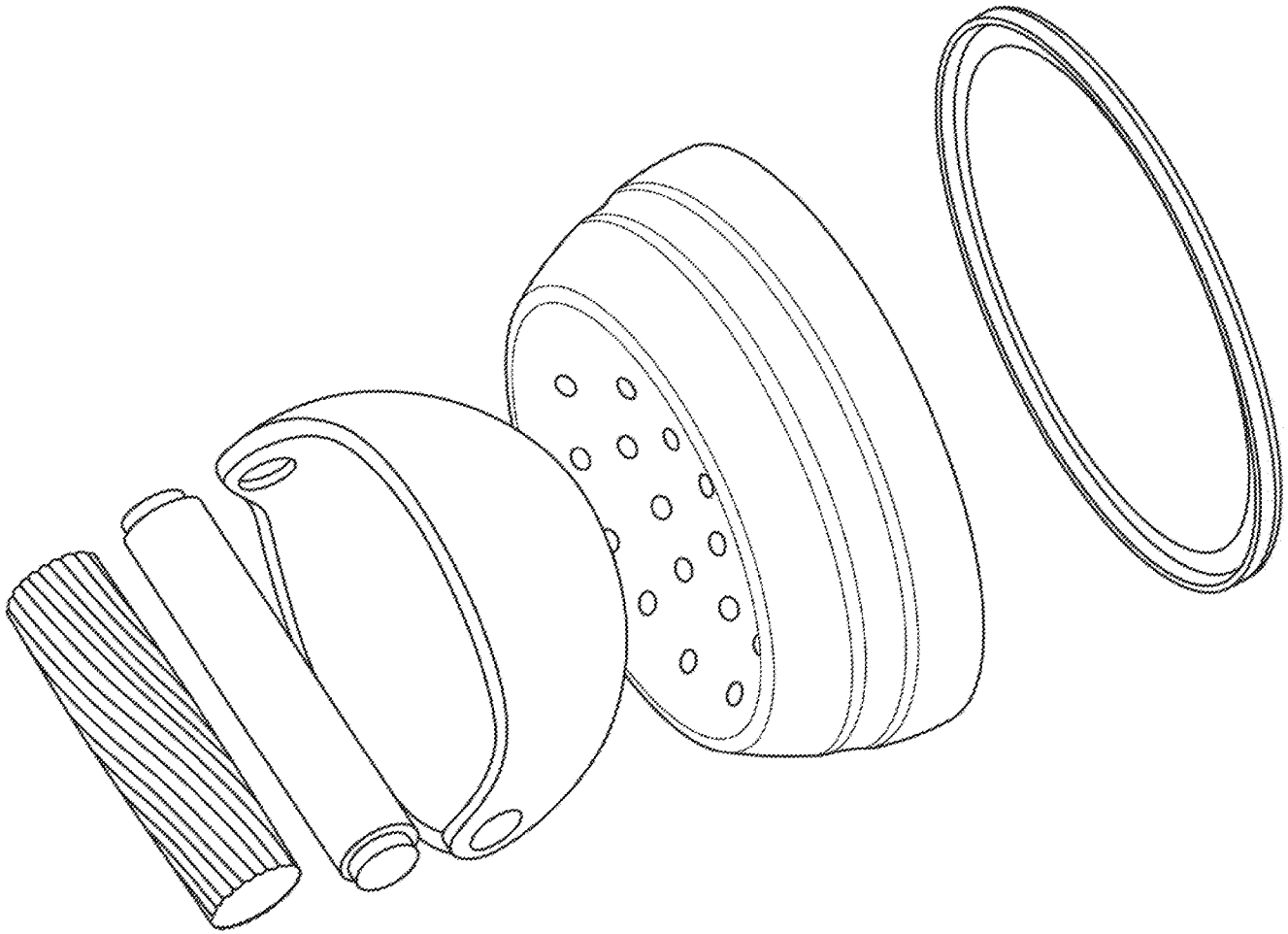
FIG. 21 depicts an exploded view of exemplary components.

Handle 140 may have a thermo-plastic elastomer coating, or other suitable non-slip material. An exploded view of exemplary components is depicted in FIG. 21. The base may further comprise a rubber gasket or other suitable non-slip mechanism for preventing the base from slipping on a floor surface.

Exemplary dimensions for base 120 (see FIG. 1) are: diameter 125 mm, height 42 mm. Exemplary dimensions for handle component 130 are: diameter 140 mm, height 90 mm. Those skilled in the art will understand that these dimensions are entirely exemplary, and that other dimensions may be used. For example, an exemplary embodiment (depicted in FIGS. 20-24) uses a base 120 of diameter 222 mm and height 80 mm, with a handle component 130 of diameter 160 mm and height 100 mm.

Other embodiments are depicted in FIGS. 25-31.

In an exemplary embodiment, the hand held (handle component) portion rides on three nylon transfer ball bearings snapped into the bowl base, each comprising one nylon ball that rides on several steel balls. The handle (grip structure) may comprise one plastic piece that is dropped into the top structure and is secured with metal fasteners. The handle may be covered with a foam sleeve (grip). The handle does not rotate, but rather the top assembly (including the bowl) is free to rotate within the base, and may be stopped by a flange running along the edge of the bowl. The base may have a rubber stopping bottom to prevent skidding.

Figure 25:
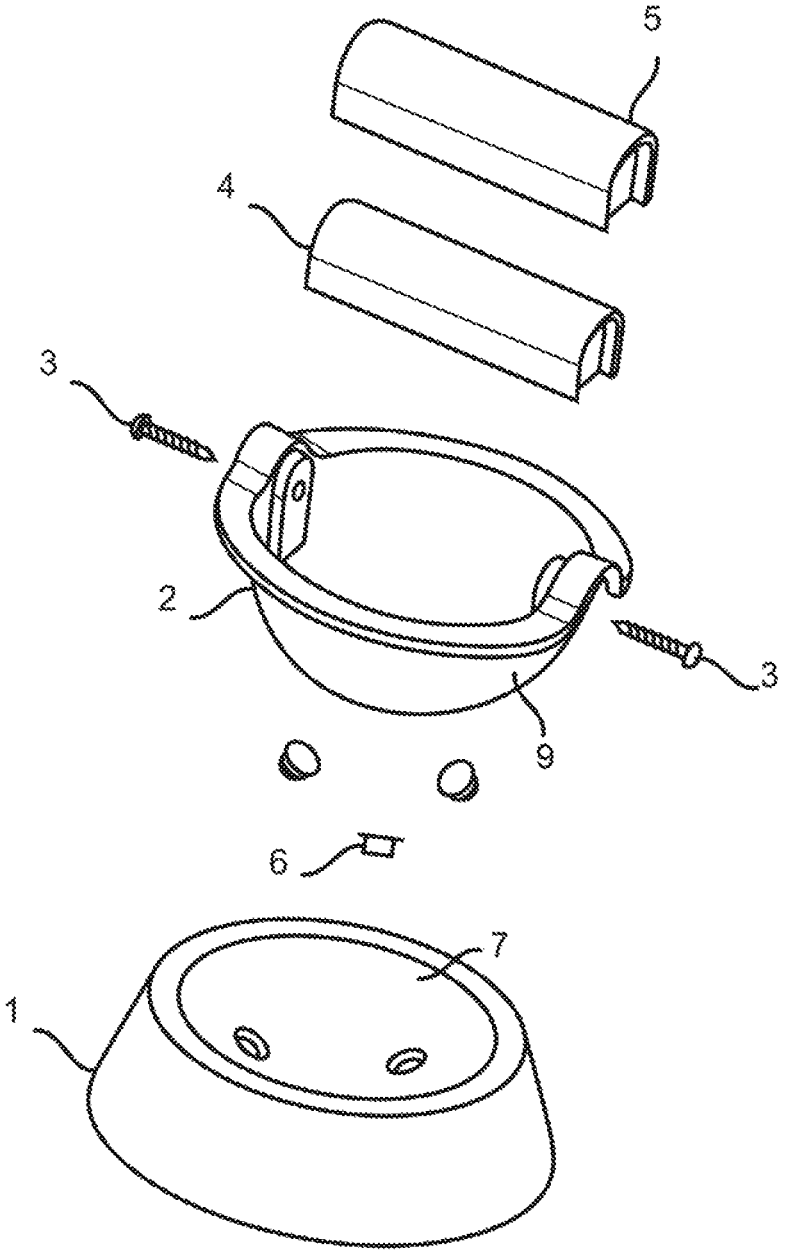
FIG. 25 depicts an exemplary embodiment.

FIG. 25 depicts an example of the above-described embodiments. The base (1) and the bowl (2) may be constructed of polished polypropylene. The screws (3) may be constructed of zinc-plated steel. The grip structure (4) may be constructed of polypropylene, and the grip (5) may be constructed of ethylene-vinyl acetate. The conveyor ball transfer assemblies (6) may have housings constructed of nylon. The base (1) includes a lower surface (8) (see FIG. 31) and a concave upper surface (7). The handle component includes one or more of the bowl (2), the screws (3), the grip stricture (4) and the grip (5). Bowl (2) of the handle component includes a convex lower surface (9).

In one or more exemplary embodiments, conveyor ball transfer assemblies comprise a nylon ball trapped in a nylon housing, riding on a plurality of smaller steel balls. Those skilled in the art will recognize that various conveyor ball transfer assemblies may be used without departing from the scope of the subject embodiments.

Figure 26:
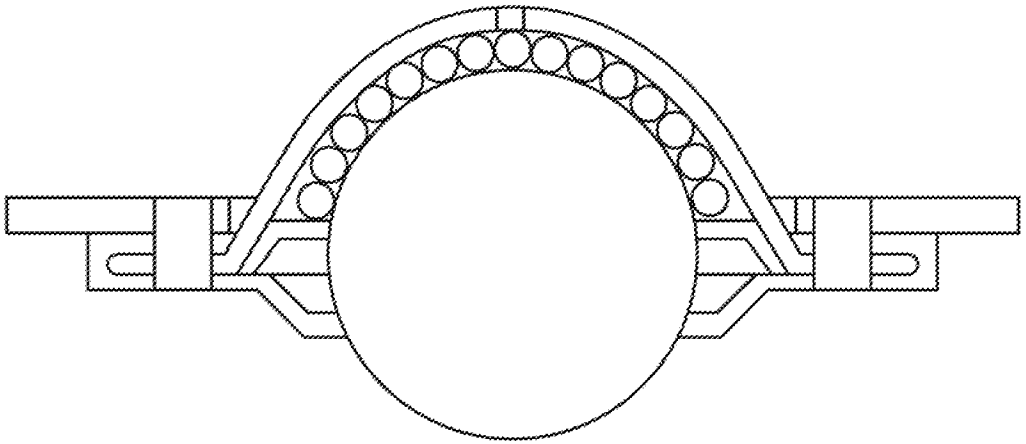
FIG. 26 depicts a detailed view of an exemplary conveyor ball transfer assembly.

One example of a suitable conveyor ball transfer assembly is shown in FIG. 26. Suitable conveyor ball transfer assemblies also are available from other well-known sources.

In an exemplary embodiment, the conveyor ball transfer assembly is 10.5 mm high, the ball diameter is 8 mm, and the housing is nylon.

Figure 27:
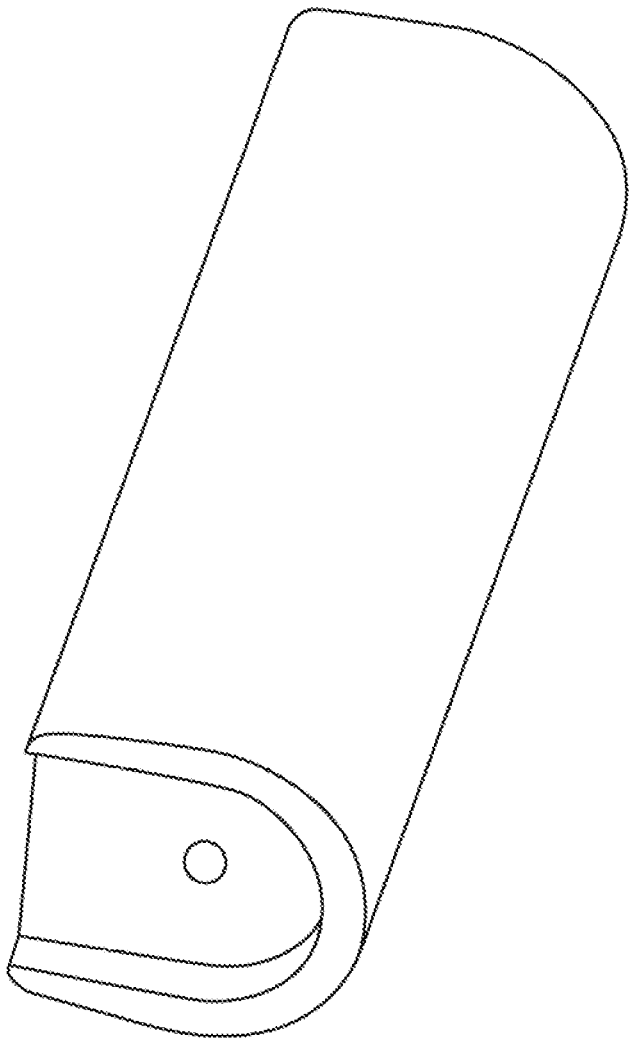
FIG. 27 depicts an exemplary grip.

FIG. 27 depicts an exemplary grip.

Figure 28:
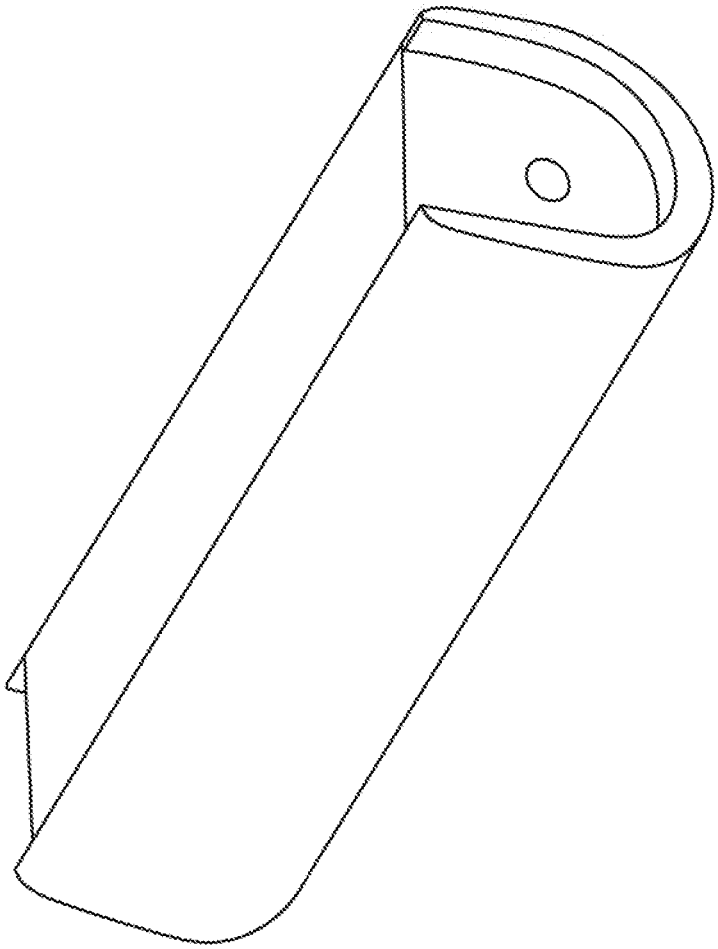
FIG. 28 depicts an exemplary grip structure.

FIG. 28 depicts an exemplary grip structure.

Figure 29:
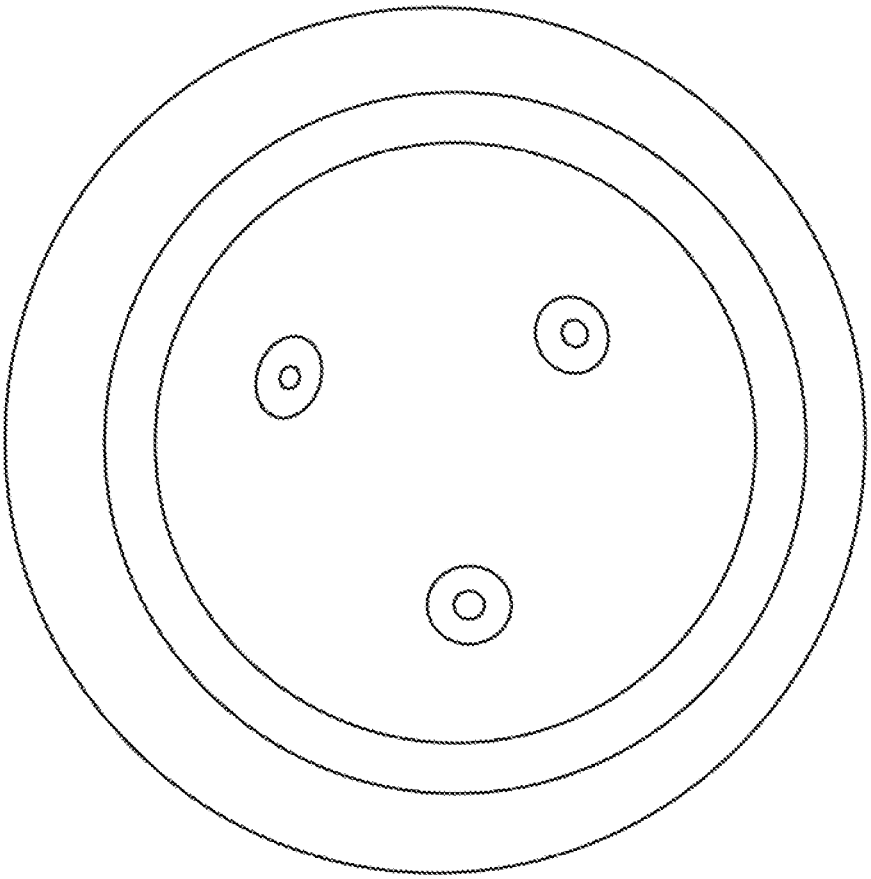
FIGS. 29 and 30 depict an exemplary base top.
Figure 30:
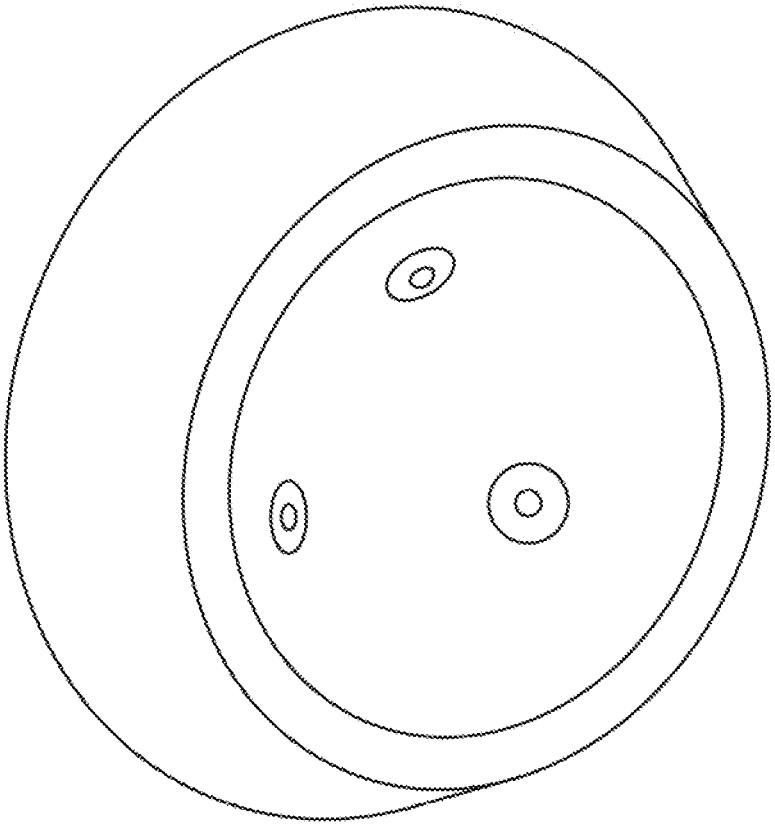

FIGS. 29 and 30 depict an exemplary base top.

Figure 31:
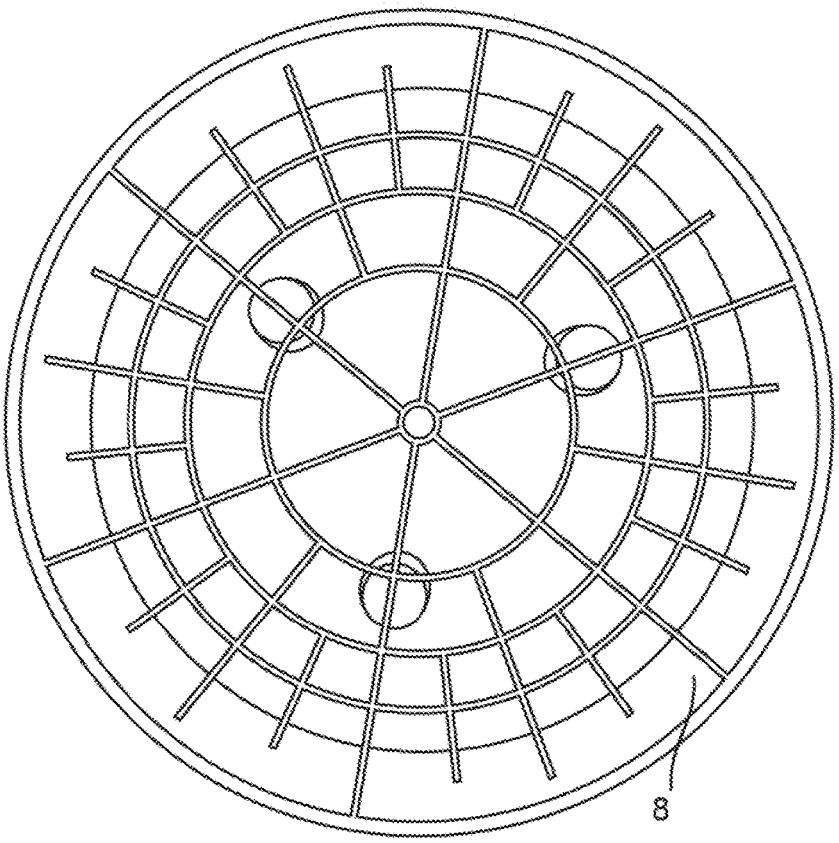
FIG. 31 depicts an exemplary base bottom.

FIG. 31 depicts an exemplary base bottom.

Figure 32:
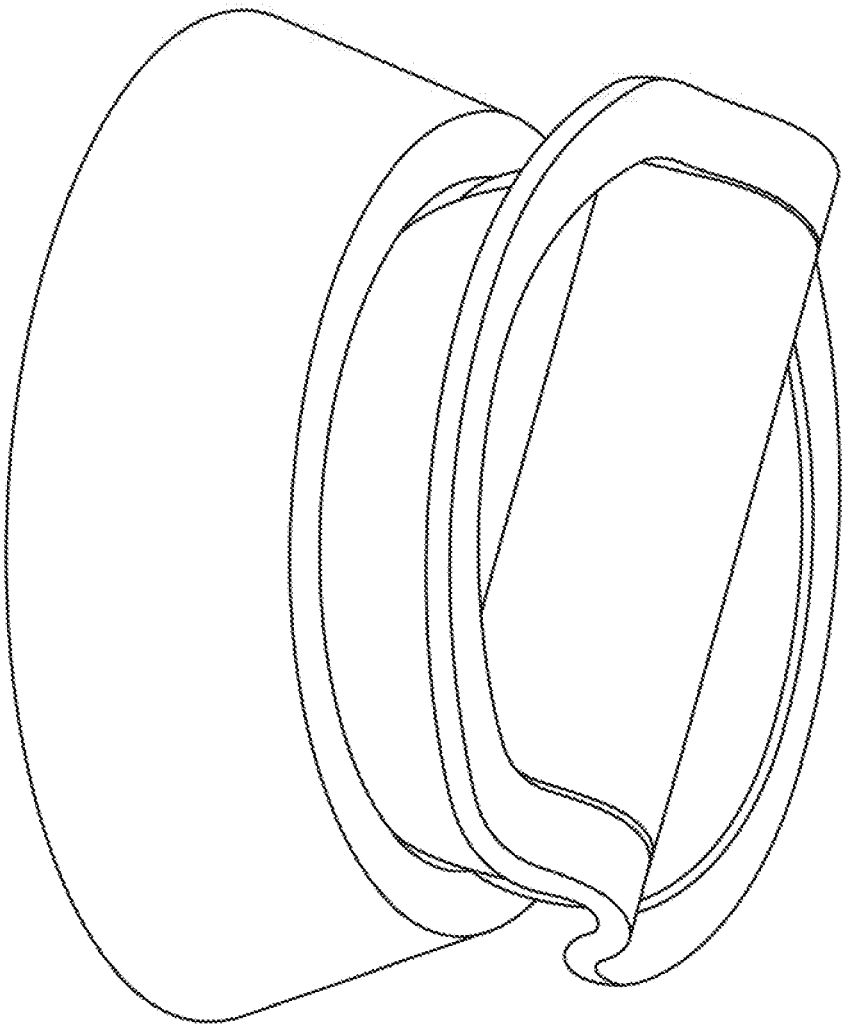
FIG. 32 depicts an exemplary embodiment.
Figure 33:
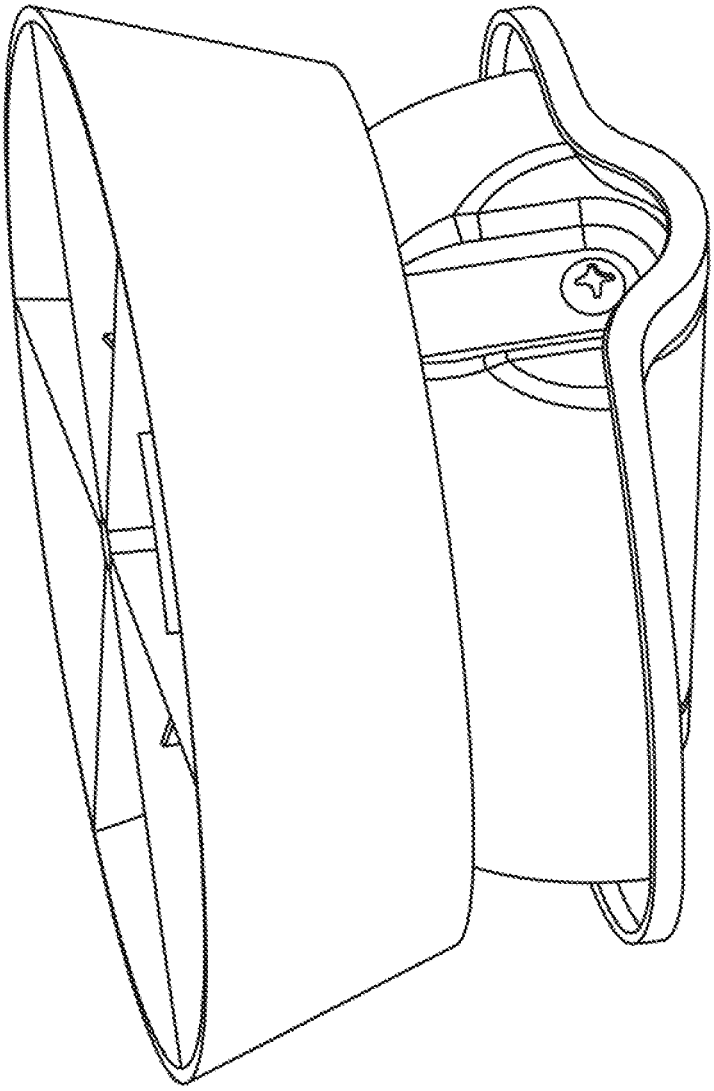
FIGS. 33-37 depict additional exemplary embodiments.
Figure 34:
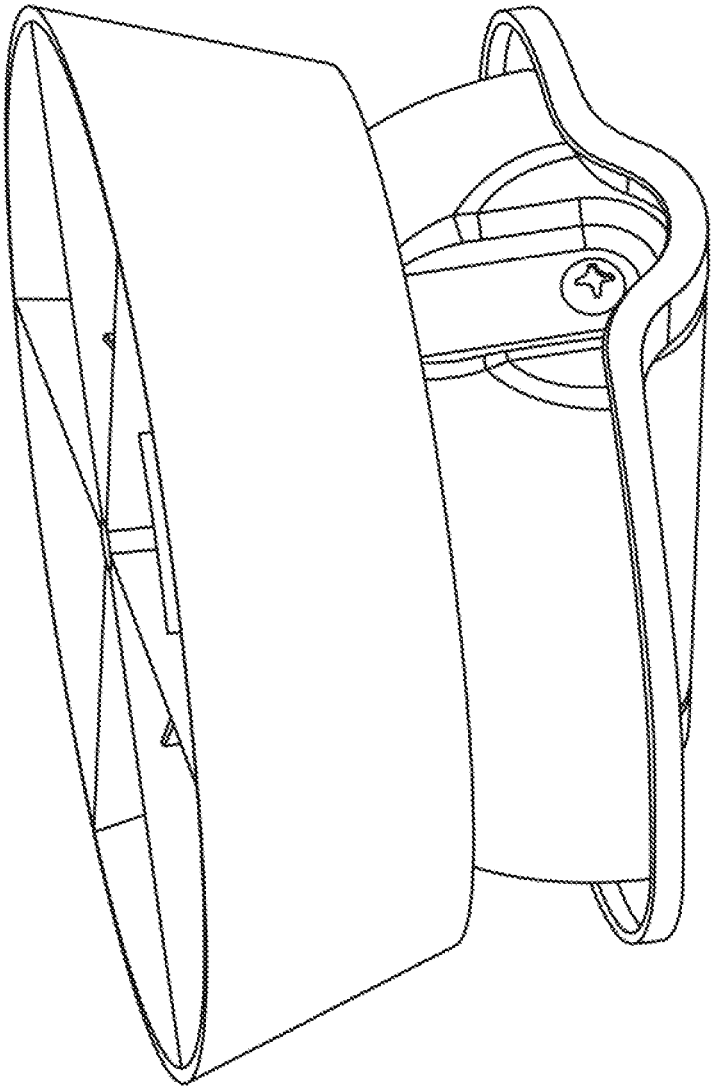
Figure 35:
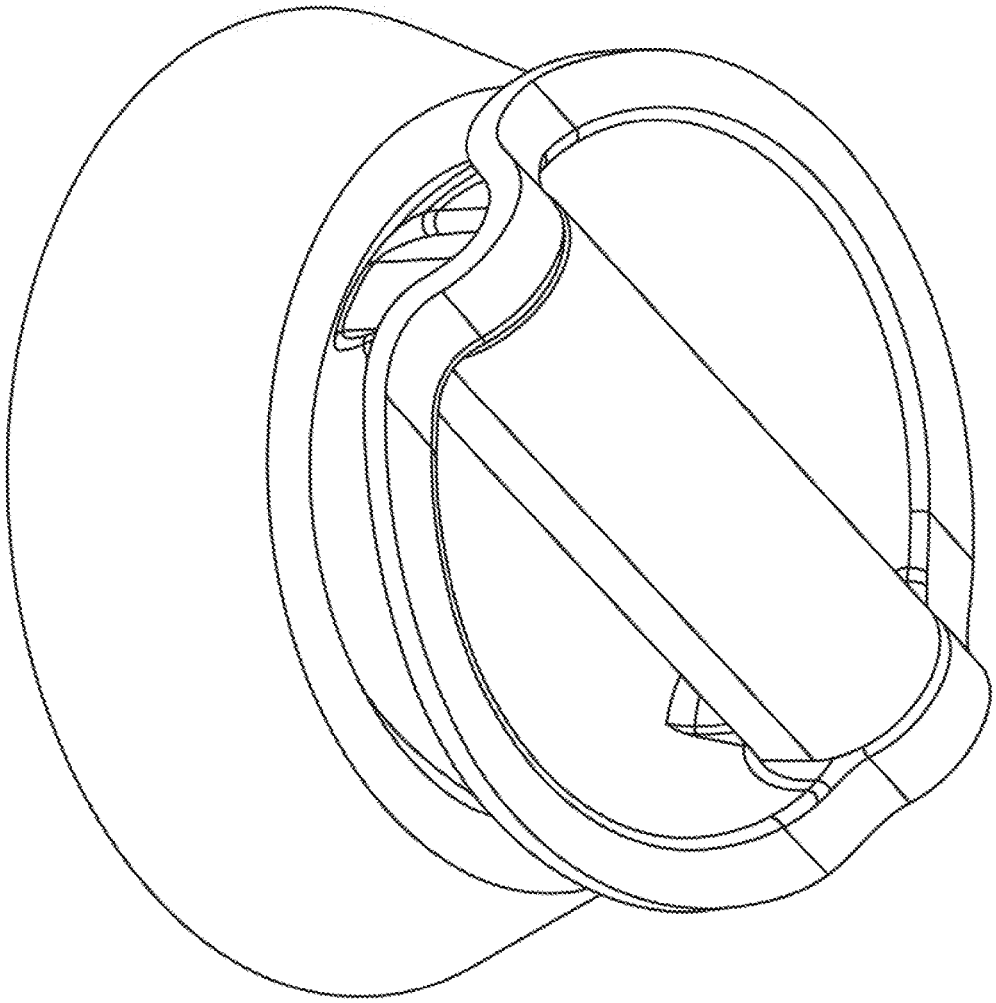
Figure 36:
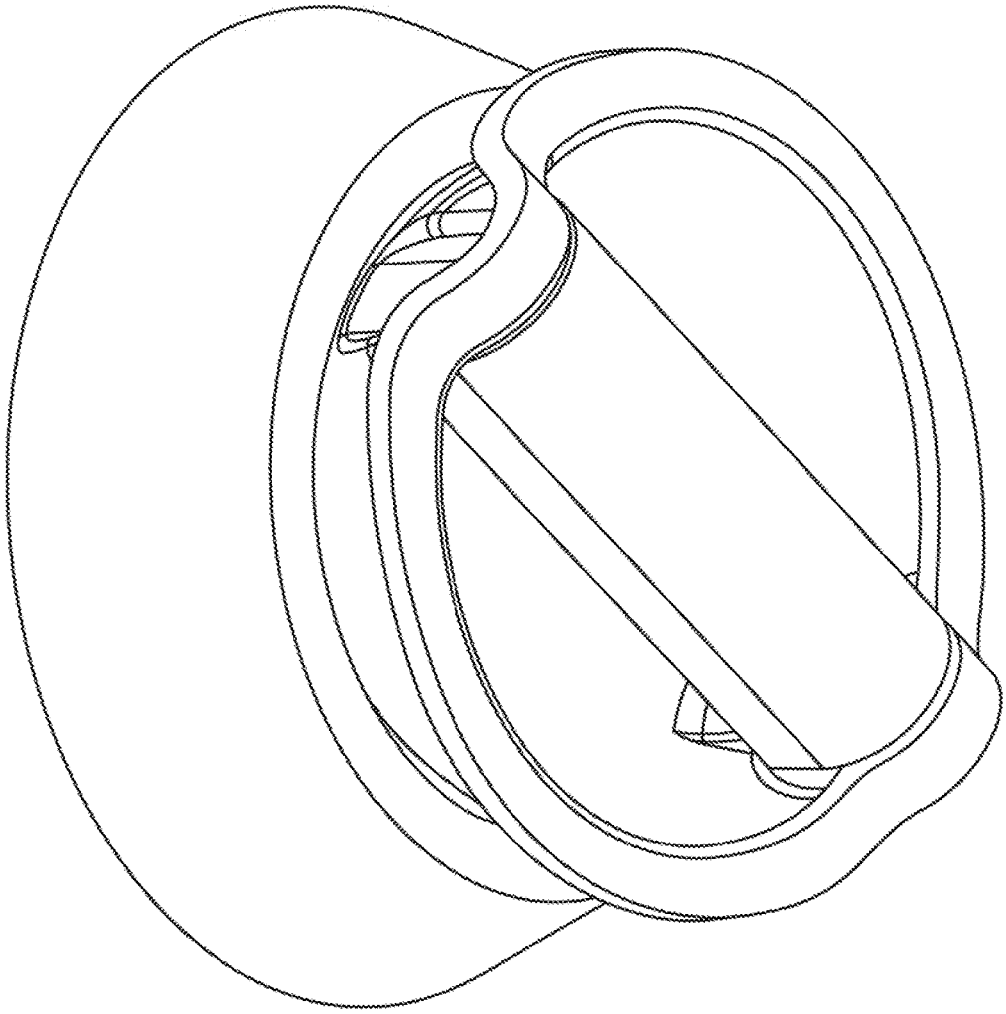
Figure 37:
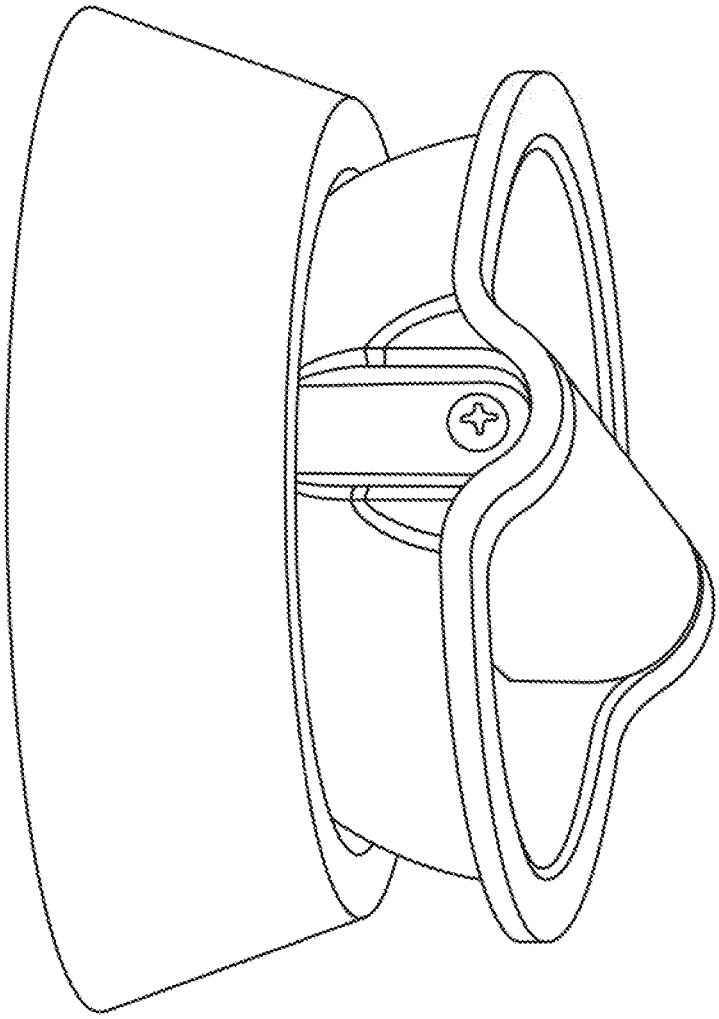
Figure 38:
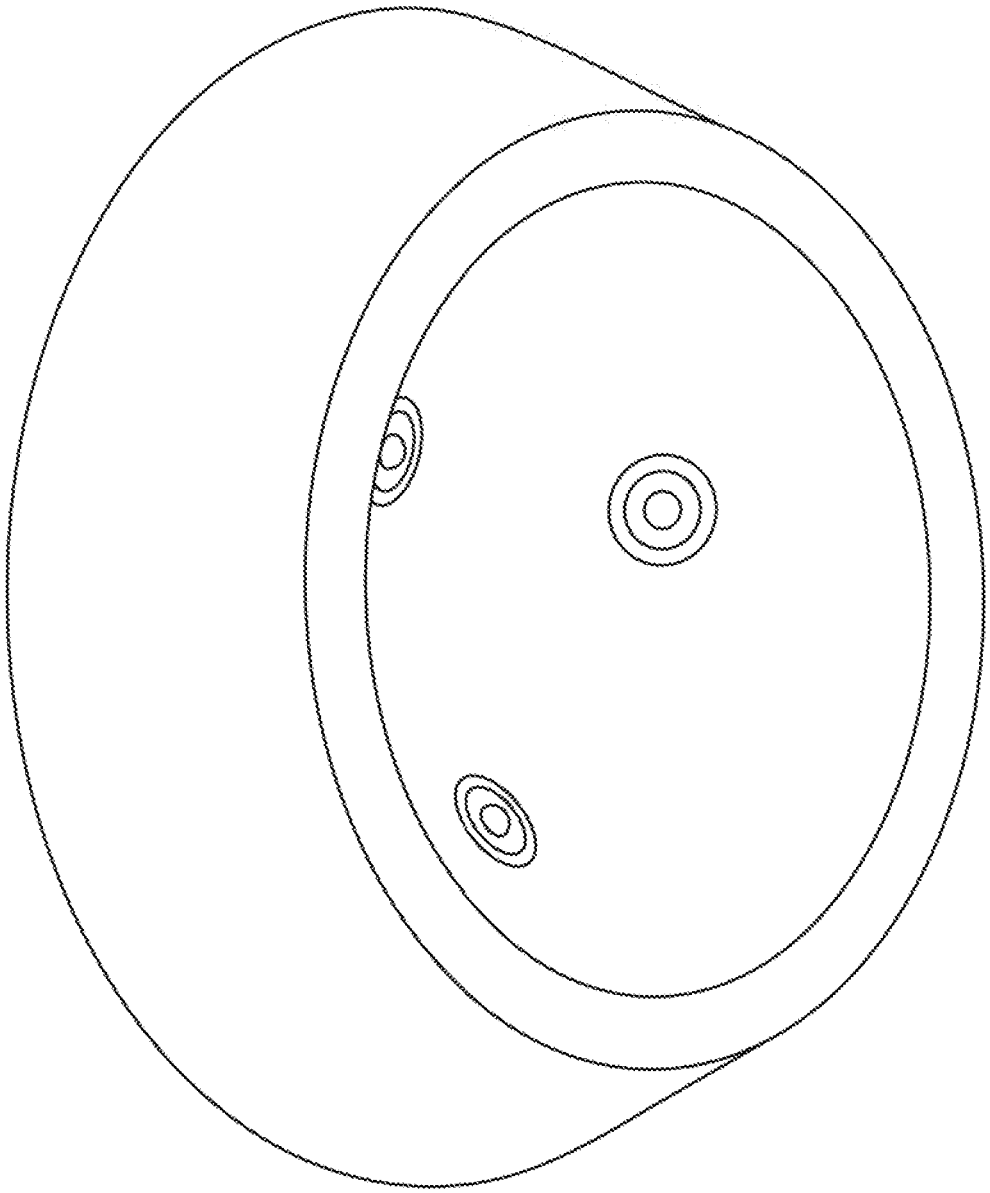
FIGS. 38-43 depict bases that may be used in exemplary embodiments.
Figure 39:
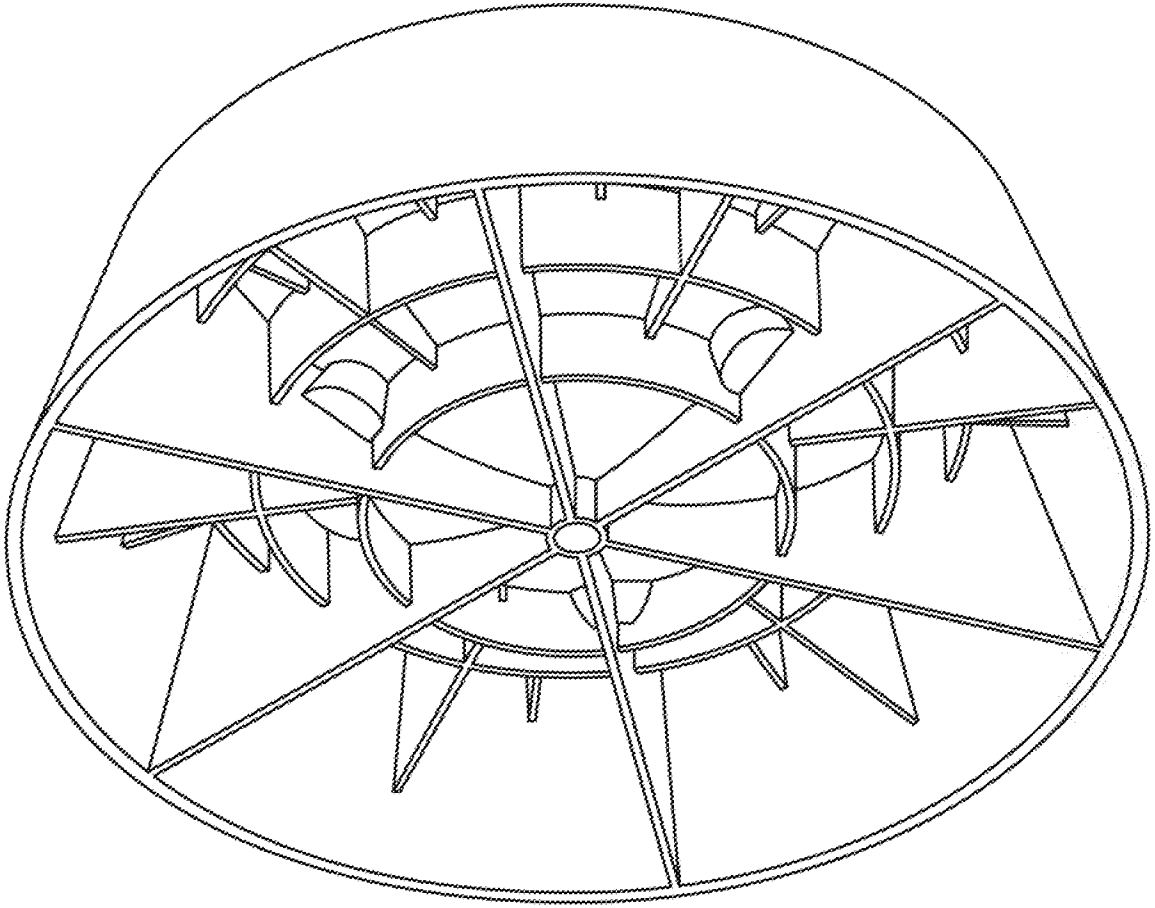
Figure 40:
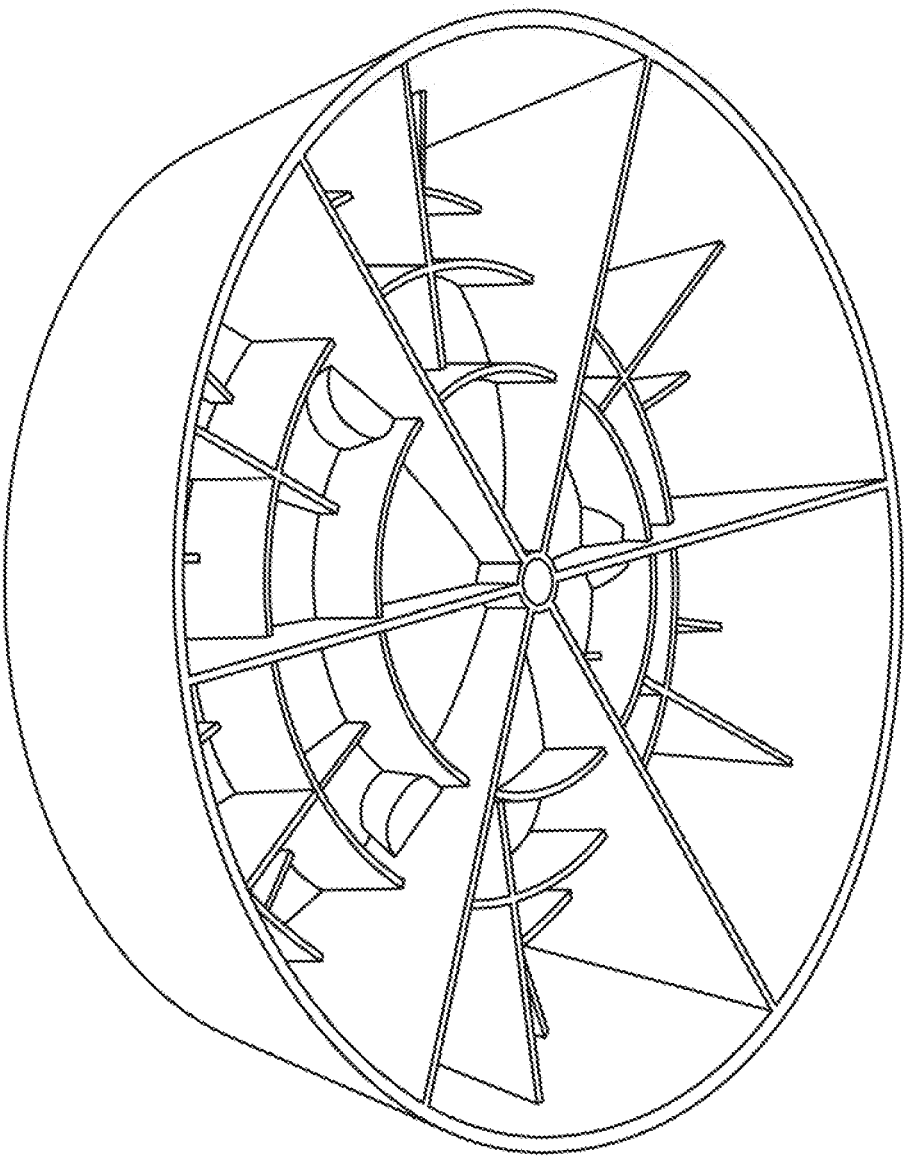
Figure 41:
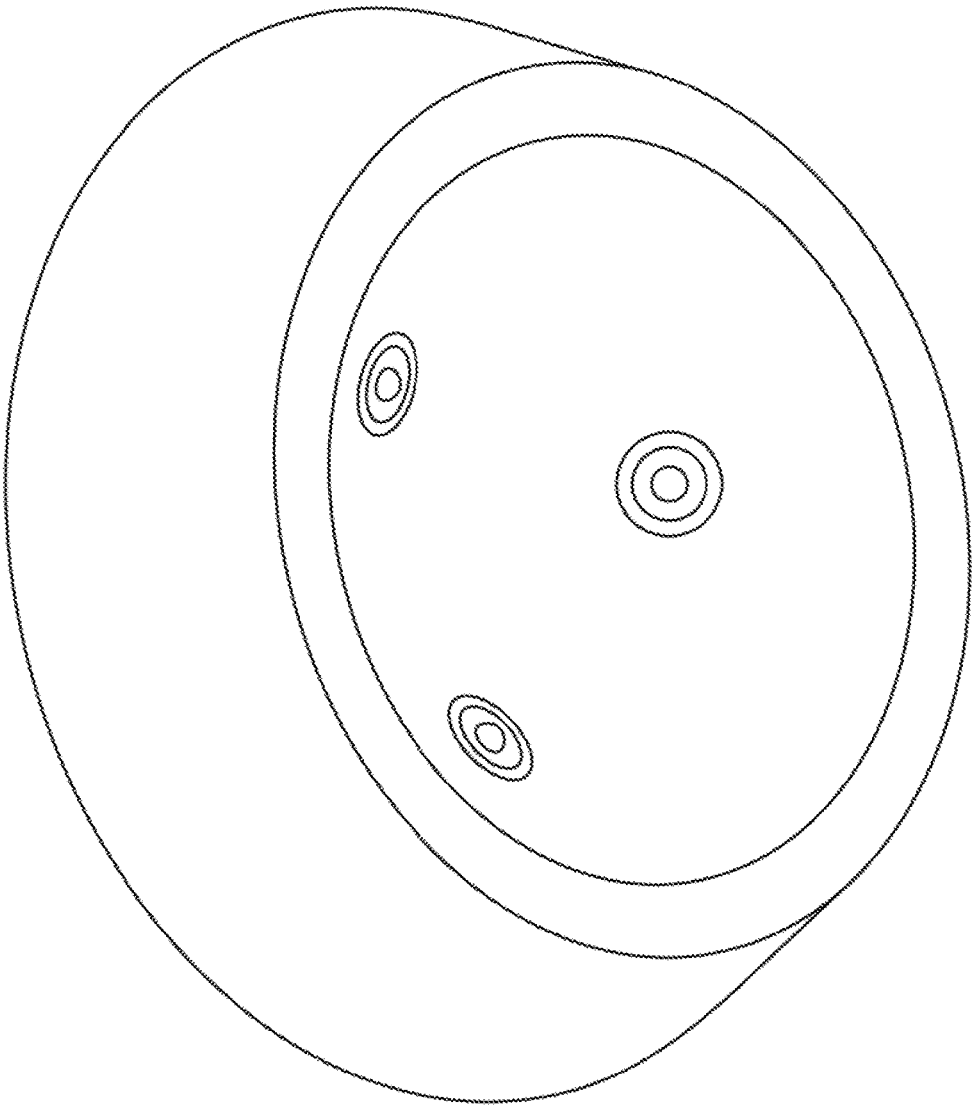
Figure 42:
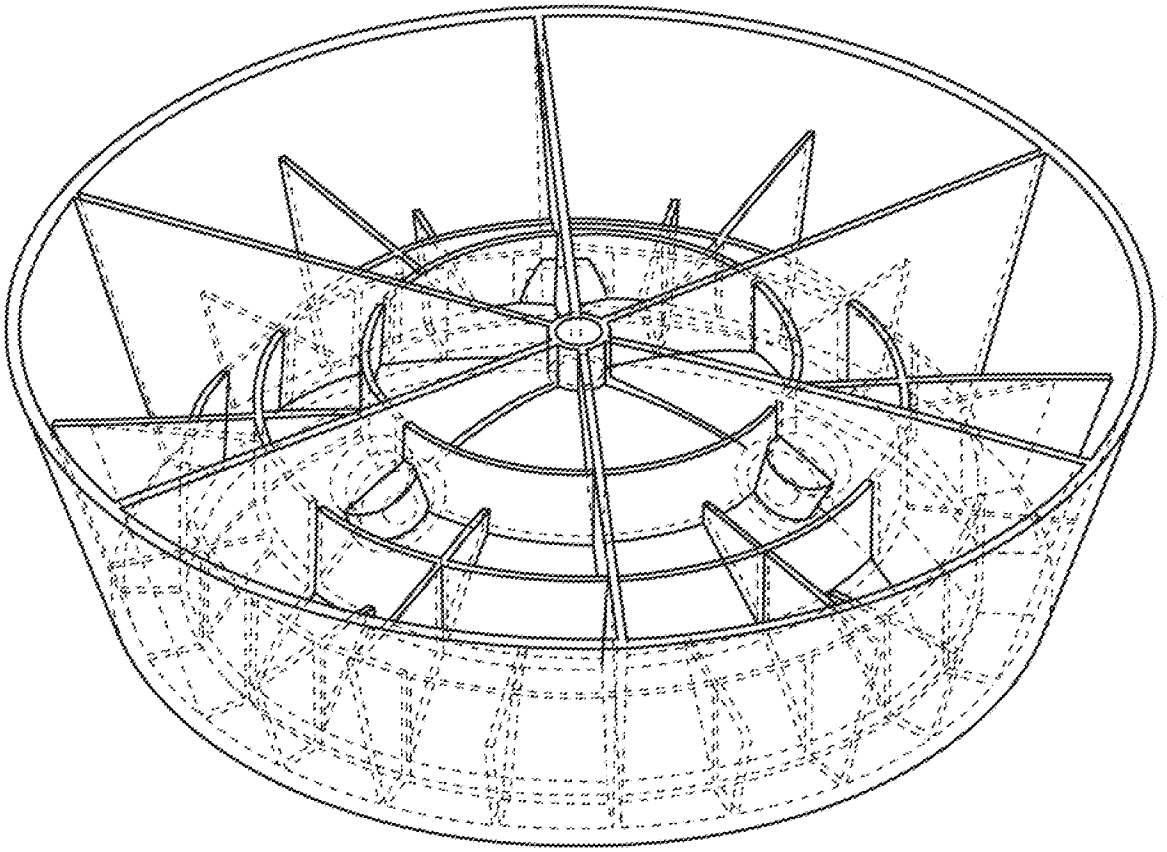
Figure 43:
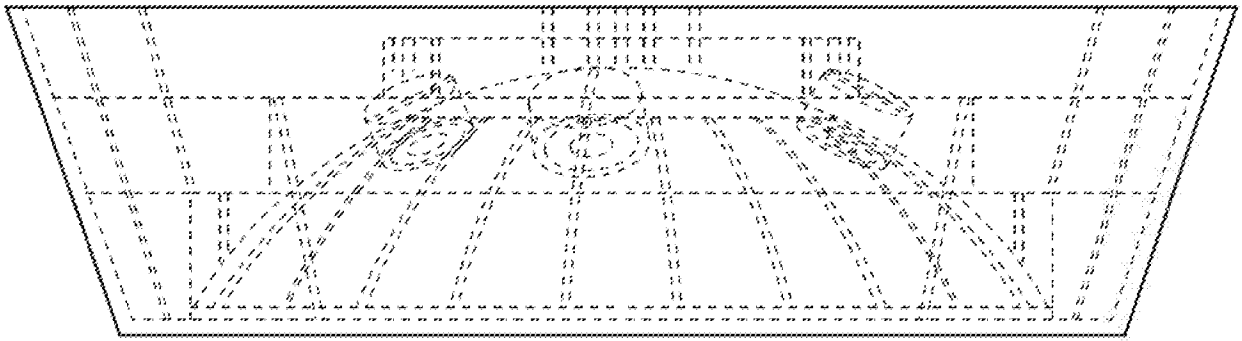
Figure 44:
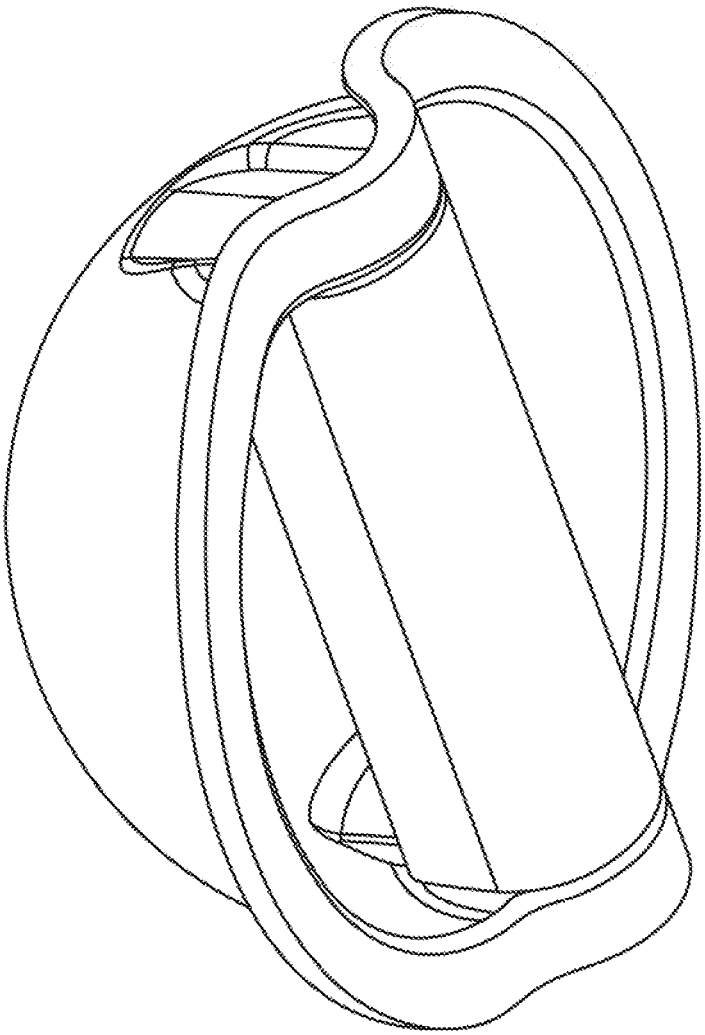
FIGS. 44-48 depict handle components that may be used in exemplary embodiments.
Figure 45:
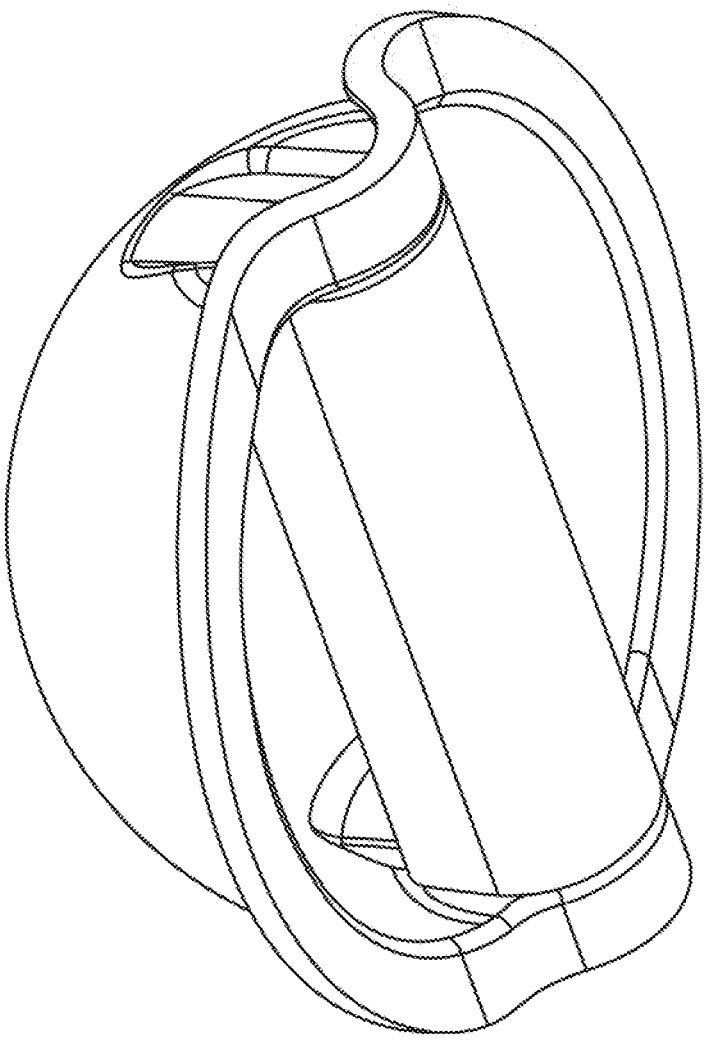
Figure 46:
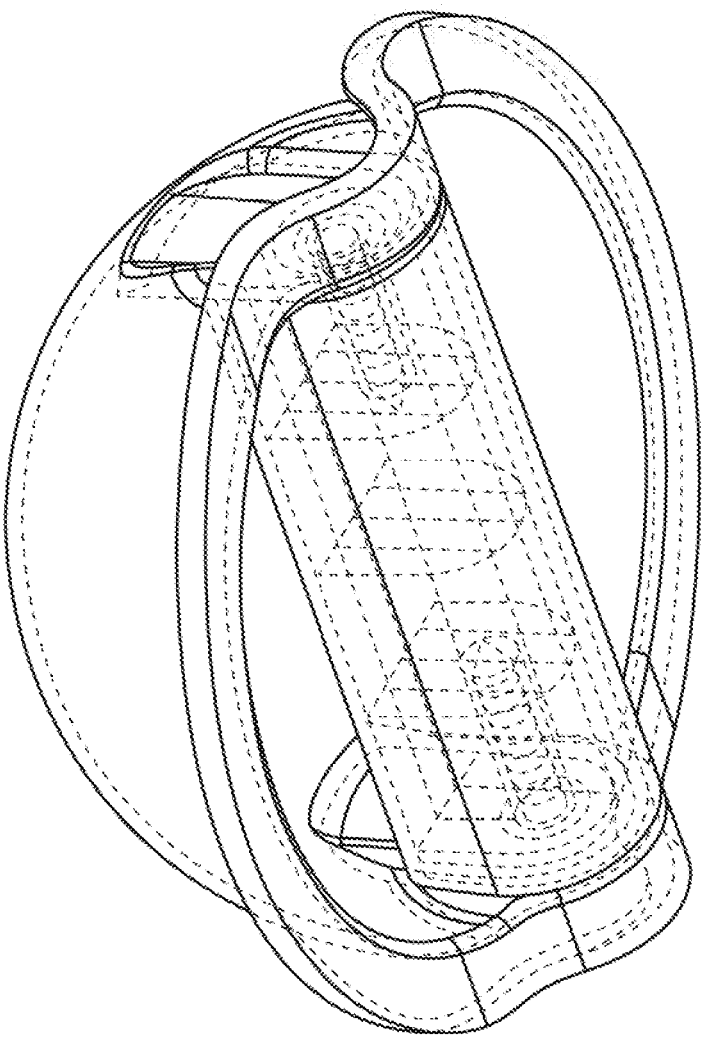
Figure 47:
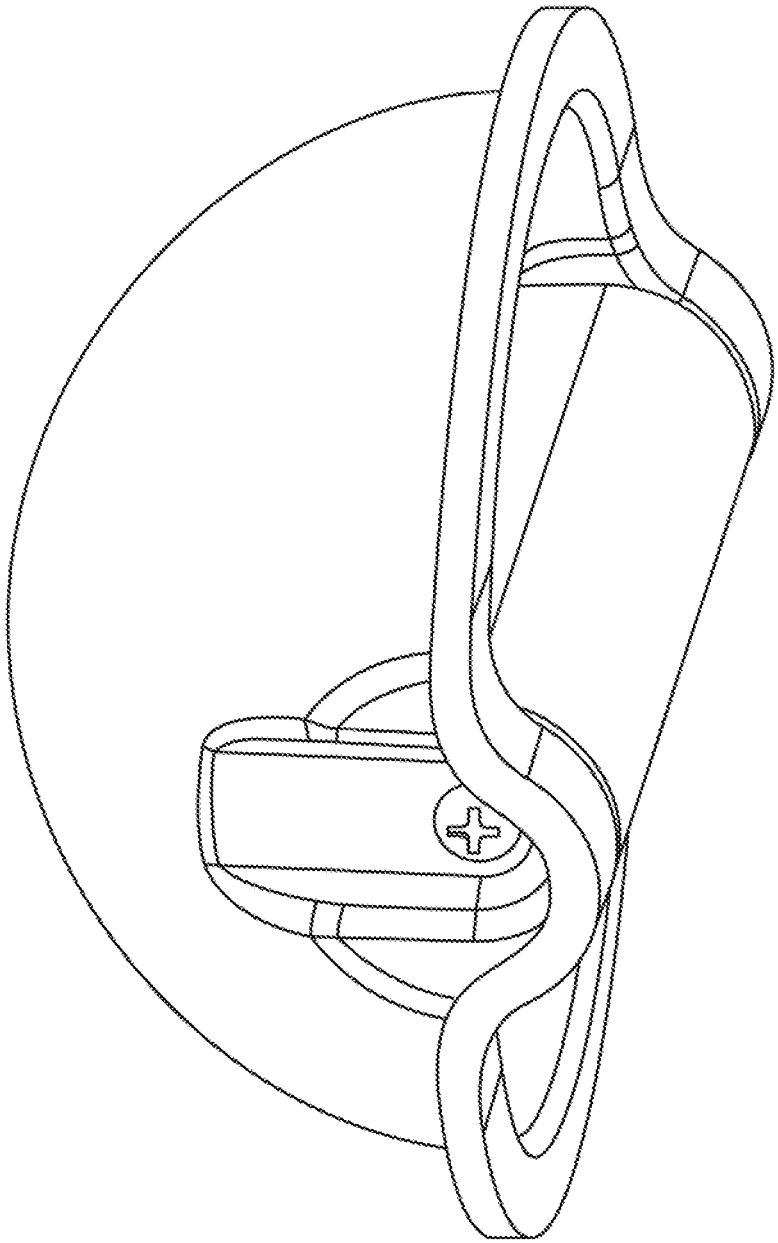
Figure 48:
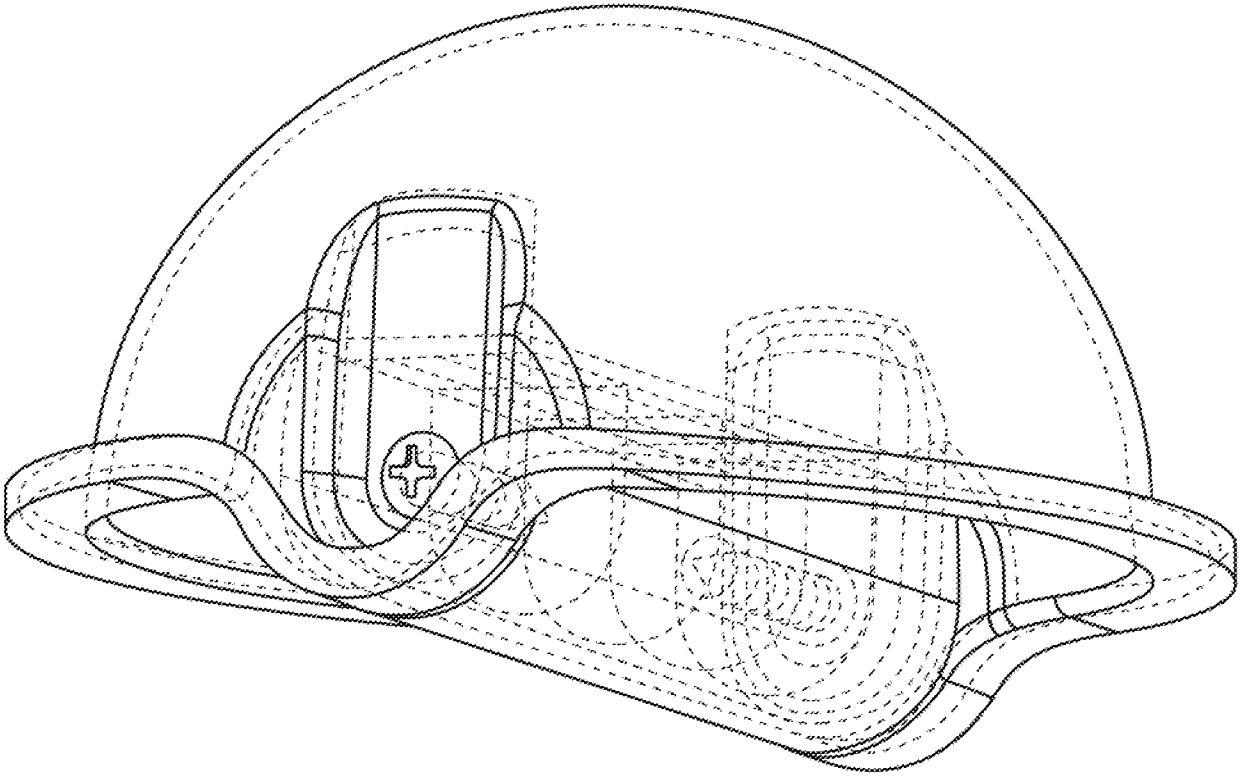

FIG. 32 depicts an exemplary embodiment.

FIGS. 33-37 depict additional exemplary embodiments.

FIGS. 38-43 depict bases that may be used in exemplary embodiments.

FIGS. 44-48 depict handle components that may be used in exemplary embodiments.

Those skilled in the art will understand that the above-specified materials are exemplary only, and that other suitable materials may be used without departing from the scope of the invention.

While certain exemplary aspects and embodiments have been described herein, many alternatives, modifications, and variations will be apparent to those skilled in the art. Accordingly, exemplary aspects and embodiments set forth herein are intended to be illustrative, not limiting. Various modifications may be made without departing from the spirit and scope of the disclosure.

We claim:

1. An apparatus comprising:

a base component comprising a lower surface and a concave upper surface having a first curvature; and a handle component comprising a convex lower surface having a second curvature;

wherein the first curvature and the second curvature are configured to conform to allow the handle component to rotate three-dimensionally within the base component, wherein the concave upper surface or the convex lower surface is configured to allow the handle component to rotate three-dimensionally within the base component, and wherein the concave upper surface or the convex lower surface comprises a plurality of conveyor ball transfer assemblies.

2. The apparatus of claim 1, wherein the handle component comprises a handle component concave upper surface on an opposite side of the convex lower surface.

3. The apparatus of claim 2, wherein the handle component comprises a handle that extends between opposite sides of the handle component concave upper surface.

4. The apparatus of claim 3, wherein the handle is enclosed within a foam grip.

5. The apparatus of claim 1, wherein the concave upper surface or the convex lower surface comprises a non-stick coating.

6. The apparatus of claim 1, wherein the concave upper surface or the convex lower surface comprises a hook-and-loop fastener.

7. The apparatus as of claim 1, wherein each of the conveyor ball transfer assemblies comprises a single ball having a first diameter, which rides on a plurality of balls, each having a second diameter.

8. The apparatus of claim 7, wherein the single ball is a nylon ball.

9. The apparatus of claim 7, wherein the plurality of balls are steel balls.

10. The apparatus of claim 1, wherein the concave upper surface or the convex lower surface comprises a non-stick coating.

* * * * *